US007826786B2

(12) United States Patent
Suda et al.

(10) Patent No.: US 7,826,786 B2
(45) Date of Patent: Nov. 2, 2010

(54) IMAGE FORMING APPARATUS, LUBRICANT APPLYING DEVICE, TRANSFER DEVICE, PROCESS CARTRIDGE, AND TONER

(75) Inventors: Takeo Suda, Tokyo (JP); Shinichi Kawahara, Tokyo (JP); Takatsugu Fujishiro, Tokyo (JP); Tokuya Ojimi, Kanagawa (JP); Takeshi Tabuchi, Kanagawa (JP); Masato Yanagida, Kanagawa (JP); Haruji Mizuishi, Tokyo (JP); Teruyuki Kasuga, Kanagawa (JP); Hiroomi Harada, Kanagawa (JP); Shuji Tanaka, Kanagawa (JP); Takaaki Tawada, Kanagawa (JP); Hiroshi Ono, Tokyo (JP); Ken Amemiya, Tokyo (JP); Toshio Koike, Kanagawa (JP); Yuji Arai, Kanagawa (JP); Masanori Kawasumi, Kanagawa (JP); Takuzi Yoneda, Tokyo (JP); Masami Tomita, Shizuoka (JP); Yutaka Takahashi, Tokyo (JP); Yoshio Hattori, Kanagawa (JP); Keiichi Yoshida, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 1119 days.

(21) Appl. No.: 10/588,957

(22) PCT Filed: Dec. 6, 2005

(86) PCT No.: PCT/JP2005/022731

§ 371 (c)(1),
(2), (4) Date: Aug. 10, 2006

(87) PCT Pub. No.: WO2006/062229

PCT Pub. Date: Jun. 15, 2006

(65) Prior Publication Data

US 2007/0183824 A1 Aug. 9, 2007

(30) Foreign Application Priority Data

| | | |
|---|---|---|
| Dec. 10, 2004 | (JP) | 2004-358884 |
| Jan. 20, 2005 | (JP) | 2005-012739 |
| Feb. 9, 2005 | (JP) | 2005-033312 |
| Feb. 23, 2005 | (JP) | 2005-047225 |
| Jul. 7, 2005 | (JP) | 2005-198570 |

(51) Int. Cl.
*G03G 21/00* (2006.01)

(52) U.S. Cl. ..... 399/346; 399/350

(58) Field of Classification Search ..... 399/346, 399/350

See application file for complete search history.

(56) References Cited

U.S. PATENT DOCUMENTS 6,445,896 B1 9/2002 Satoh

FOREIGN PATENT DOCUMENTS

JP 56-74283 6/1981

(Continued)

OTHER PUBLICATIONS

Machine Translation JP 2001-305907.*

(Continued)

*Primary Examiner*—David P Porta
*Assistant Examiner*—Bryan P Ready
(74) *Attorney, Agent, or Firm*—Oblon, Spivak, McClelland, Maier & Neustadt, L.LP:

(57) ABSTRACT

In an image forming apparatus, an area applied with a lubricant, i.e., an area of a lubricant layer having a uniform thickness, is obtained by spreading the lubricant by a lubricant smoothing blade. The area applied with a lubricant covers an area cleaned by a cleaning blade, i.e., a contact portion of the cleaning blade with a photoconductor.

13 Claims, 15 Drawing Sheets

U.S. PATENT DOCUMENTS

| | | | | |
|---|---|---|---|---|
| 6,807,390 | B2 | 10/2004 | Suda et al. | |
| 7,010,246 | B2 | 3/2006 | Fujishiro et al. | |
| 7,027,751 | B2 | 4/2006 | Miura et al. | |
| 7,035,582 | B2 | 4/2006 | Suda et al. | |
| 7,062,207 | B2 | 6/2006 | Tsuda et al. | |
| 7,065,317 | B2 | 6/2006 | Suda | |
| 7,072,602 | B2 | 7/2006 | Hatori et al. | |
| 2004/0013442 | A1 | 1/2004 | Suzuki et al. | |
| 2004/0109711 | A1* | 6/2004 | Kanagawa | 399/350 |
| 2004/0136763 | A1* | 7/2004 | Murakami et al. | 399/350 |
| 2004/0170447 | A1 | 9/2004 | Arai et al. | |
| 2005/0084304 | A1 | 4/2005 | Kataoka et al. | |
| 2005/0152722 | A1 | 7/2005 | Tawada et al. | |
| 2005/0196194 | A1 | 9/2005 | Suda et al. | |
| 2005/0249533 | A1 | 11/2005 | Suda et al. | |
| 2005/0281590 | A1 | 12/2005 | Tsuda et al. | |

FOREIGN PATENT DOCUMENTS

| | | |
|---|---|---|
| JP | 5-35155 | 2/1993 |
| JP | 6-342236 | 12/1994 |
| JP | 07-5794 | 1/1995 |
| JP | 8-254933 | 10/1996 |
| JP | 9-81005 | 3/1997 |
| JP | 9-319274 | 12/1997 |
| JP | 10-232571 | 9/1998 |
| JP | 10-260614 | 9/1998 |
| JP | 11-65311 | 3/1999 |
| JP | 11-65391 | 3/1999 |
| JP | 2000-172138 | 6/2000 |
| JP | 2000-206722 | 7/2000 |
| JP | 2000-221838 | 8/2000 |
| JP | 2000-242135 | 9/2000 |
| JP | 2000-330443 | 11/2000 |
| JP | 2000-352832 | 12/2000 |
| JP | 2001-100491 | 4/2001 |
| JP | 2001-305907 | 11/2001 |
| JP | 2001-324858 | 11/2001 |
| JP | 2002-6679 | 1/2002 |
| JP | 2002-55580 | 2/2002 |
| JP | 2002-244485 | 8/2002 |
| JP | 2002-341578 | 11/2002 |
| JP | 2003-43885 | 2/2003 |
| JP | 2003-43888 | 2/2003 |
| JP | 2003-57996 | 2/2003 |
| JP | 2003-91143 | 3/2003 |
| JP | 2004-37516 | 2/2004 |
| JP | 2004-86234 | 3/2004 |
| JP | 2004-109234 | 4/2004 |
| JP | 2004-126383 | 4/2004 |
| JP | 2004-170440 | 6/2004 |
| JP | 2004-226685 | 8/2004 |
| JP | 2004-309940 | 11/2004 |
| JP | 2004-334092 | 11/2004 |
| JP | 2004-354695 | 12/2004 |
| JP | 2005-99729 | 4/2005 |

OTHER PUBLICATIONS

Machine Translation JP 07-005794.*
Machine Translation JP 2000-330443.*
U.S. Appl. No. 11/853,529, filed Sep. 11, 2007, Kawahara, et al.
U.S. Appl. No. 12/014,557, filed Jan. 15, 2008, Harada.
U.S. Appl. No. 12/049,838, filed Mar. 17, 2008, Senoh, et al.
U.S. Appl. No. 12/210,715, filed Sep. 15, 2008, Takahashi et al.

* cited by examiner

COUNTER MANNER

TRAILING MANNER

IMAGE FORMING APPARATUS, LUBRICANT APPLYING DEVICE, TRANSFER DEVICE, PROCESS CARTRIDGE, AND TONER

TECHNICAL FIELD

The present invention relates to an image forming apparatus, and a lubricant applying device, a transfer device, a process cartridge, and toner used for an image carrier of the image forming apparatus.

BACKGROUND ART

Recently, there is an increasing requirement for forming high quality images. To obtain such images, a finer and highly spherical toner needs to be used. Polymer toners can be suitably used as finer and highly spherical toners.

In the image forming apparatuses, excess toner that remains on the surface of a photoconductor after image formation is commonly cleaned with a cleaning means. However, as the toner becomes finer and more spherical, it becomes difficult to clean it. For example, a cleaning blade, which is a commonly used cleaning means, can not properly clean the excess toner. One approach is to more strongly press the cleaning blade against the surface of the photoconductor, however, the photoconductor can get damaged. Another approach is to apply a lubricant on the surface of the photoconductor. However, if the lubricant is not applied uniformly, the quality of the toner image can degrade.

Sometimes both of the above approaches are employed. In that case there can be two options: apply a lubricant first and then clean excess toner, or clean excess toner first and then apply a lubricant. In Japanese Patent Application Laid-Open (JP-A) No. 2001-305907, the applicant of this application has proposed a method of cleaning excess toner first and then applying a lubricant. However, this technique does not take into account a fine, spherical, polymer toner.

Various lubricants have been known. One of them is zinc stearate. It is common to use a solid rod made of zinc stearate, and use a brush roller to scrap zinc stearate from the rod and apply it to the photoconductor. A powdery lubricant can be used instead of a solid bar. However, a powdery lubricant has some disadvantageous. For example, in general, powders are difficult to manufacture and pack. Moreover, powdery lubricants can contaminate the environment.

The amount of lubricant applied also plays an important role. If the lubricant applied is too less, the lubricant may not be applied uniformly, which leads to improper cleaning and wear of the cleaning blade. On the other hand, if the lubricant applied is too much, excess lubricant can make dirty the surface of a charging roller, or even can absorb moisture, which leads to flow of an electrostatic latent image. JP-A No. H10-260614 and JP-A No. 2003-57996 discloses a technique to determine the most appropriate amount of the lubricant.

JP-A No. 2002-244485 describes a method of controlling the application amount of a lubricant based on image data information to improve cleaning capability of polymer toner. This method is the "the application after the cleaning", but it is different from the present invention in the way to smooth the application amount of the lubricant.

JP-A No. 2000-330443 describes a method of uniformly applying a lubricant to improve cleaning capability of toner. This method is the "the application after the cleaning", but it is also different from the present invention in the way to smooth the application amount of the lubricant.

JP-A No. 2000-172138 proposes an invention characterized in that an area applied with a lubricant in an axial direction of a photoconductor almost coincides with an area where a cleaning blade contacts the photoconductor. However, this invention is different from the present invention in a point how to configure the lubricant and the cleaning blade, and in another point whether a lubricant smoothing blade is provided.

DISCLOSURE OF INVENTION

Problem to be Solved by the Invention

According to an aspect of the present invention, an image forming apparatus includes a latent image carrier that is rotatable and configured to carry a latent image; a cleaning blade that cleans toner remaining on a cleaning area on the latent image carrier; and a lubricant applying element that is arranged on downstream side of the cleaning blade with respect to direction of rotation of the latent image carrier, and that applies a lubricant to a lubricant applying area on the latent image carrier, wherein the cleaning area and the lubricant applying area overlap.

According to another aspect of the present invention, an image forming apparatus includes a cleaning blade that removes toner remaining on a surface of an image carrier after a toner image is transferred; a lubricant applying device including a lubricant; and a noncontact lubricant-applying element that applies a component of the lubricant to the image carrier in a noncontact manner; and a lubricant smoothing blade that spreads the lubricant applied to the image carrier, to form a thin layer, wherein torque of the image carrier which is contacted only by the cleaning blade is higher than torque of the image carrier, with the lubricant applied, which is contacted by the cleaning blade and the lubricant smoothing blade.

According to still another aspect of the present invention, an image forming apparatus includes an image carrier on which a toner image is formed; a cleaning blade that cleans the image carrier after the toner image is transferred to a transfer material; a blade holder that holds the cleaning blade; and a lubricant applying device that applies a lubricant to the image carrier. The lubricant applying device includes a solid lubricant, a lubricant applying element, a guide that guides the solid lubricant so that the solid lubricant can move substantially only in a direction of approaching or separating from the lubricant applying element, and a pressing unit that presses the solid lubricant against the lubricant applying element. Positions of the pressing unit and the cleaning blade are respectively set so that a direction in which the pressing unit presses the solid lubricant against the lubricant applying element and a direction in which the cleaning blade is protruded toward the surface of the image carrier are almost parallel to each other, and the blade holder is fixed to the guide directly or through another element.

According to still another aspect of the present invention, a lubricant applying device includes a lubricant that is accommodated in the lubricant applying device; an applying roller that applies the lubricant to an image carrier, being an applied surface; and a smoothing element that spreads the lubricant applied to the image carrier to form a thin layer. The lubricant is applied after adherents on the applied surface are cleaned, and the lubricant applied is further smoothed.

Means for Solving Problem

According to still another aspect of the present invention, a lubricant applying device includes a solid lubricant that is accommodated in the lubricant applying device; an applying roller that contacts the solid lubricant to be adhered to the surface thereof with lubricant as a component of the solid lubricant, and applies the lubricant to an image carrier; a pressing element that presses the solid lubricant against the applying roller so that the solid lubricant contacts the applying roller; and a smoothing element that spreads the lubricant applied to the image carrier to form a thin layer. The solid lubricant is disposed in the lower side with respect to the applying roller in the direction of gravity, the pressing element is disposed in the lower side with respect to the solid lubricant in the direction of gravity, the lubricant is applied after adherents on the applied surface are cleaned, and the lubricant applied is further smoothed.

According to still another aspect of the present invention, a lubricant applying device includes a solid lubricant that is accommodated in the lubricant applying device; an applying roller that contacts the solid lubricant to be adhered to the surface thereof with lubricant as a component of the solid lubricant, and applies the lubricant to an image carrier; a pressing element that presses the solid lubricant against the applying roller so that the solid lubricant contacts the applying roller; and a smoothing element that spreads the lubricant applied to the image carrier to form a thin layer. The solid lubricant moves in a direction perpendicular to a direction of rotation of the applying roller.

According to still another aspect of the present invention, a lubricant applying device includes a solid lubricant that is accommodated in the lubricant applying device; an applying roller that contacts the solid lubricant to be adhered to the surface thereof with lubricant as a component of the solid lubricant, and applies the lubricant to an image carrier; a pressing element that presses the solid lubricant against the applying roller so that the solid lubricant contacts the applying roller; and a smoothing element that spreads the lubricant applied to the image carrier to form a thin layer. The applying roller moves in a direction perpendicular to a direction of rotation of the applying roller.

According to still another aspect of the present invention, a lubricant applying device includes a lubricant that is accommodated in the lubricant applying device; an applying roller that applies the lubricant to an image carrier; and a smoothing element of which edge portion formed with a sheet-like elastic body is pressed against the surface of the image carrier in its trailing posture, to press and spread the lubricant applied thereto. A contact angle of the smoothing element with respect to the image carrier is 10 degrees or more.

According to still another aspect of the present invention, a lubricant applying device includes a lubricant that is accommodated in the lubricant applying device; an applying roller that applies the lubricant to an image carrier; a smoothing element of which edge portion formed with a sheet-like elastic body is pressed against the surface of the image carrier in its trailing posture, to press and spread the lubricant applied thereto; and a cleaning element of which edge portion formed with a sheet-like elastic body is pressed against the surface of the image carrier in its counter posture, to remove a foreign matter from the surface thereof. The cleaning element, the applying roller, and the smoothing element are arranged in this order from an upstream side in a direction of movement of the image carrier, and a contact angle of the smoothing element with respect to the image carrier is 10 degrees or more.

According to still another aspect of the present invention, a lubricant applying device includes a lubricant that is accommodated in the lubricant applying device; an applying roller that applies the lubricant to an image carrier; a smoothing element of which edge portion formed with a sheet-like elastic body is pressed against the surface of the image carrier in its trailing posture, to press and spread the lubricant applied thereto; and a cleaning element of which edge portion formed with a sheet-like elastic body is pressed against the surface of the image carrier in its counter posture, to remove a foreign matter from the surface thereof. The cleaning element, the applying roller, and the smoothing element are arranged in this order from an upstream side in a direction of movement of the image carrier, and a contact linear pressure of the smoothing element is 0.01 N/cm or more.

According to still another aspect of the present invention, a transfer device includes a transfer element that is an image carrier; and a lubricant applying device according to the above aspects that is detachably provided in the transfer device.

According to still another aspect of the present invention, a process cartridge includes an image carrier on which a latent image is formed; and a process unit that includes at least one selected from a charging device that uniformly charges the surface of the image carrier, a developing device that supplies toner to the latent image and visualizes the latent image, a cleaning device that cleans the surface of the image carrier, and a lubricant applying device that applies lubricant to an applied surface. The process cartridge integrally supports the image carrier and the process unit, and is detachable from an image forming apparatus, and the lubricant applying device is a lubricant applying device according to above aspects of the present invention.

According to still another aspect of the present invention, an image forming apparatus includes an image carrier on which a latent image is formed; a charging device that uniformly charges the surface of the image carrier; an exposing device that exposes the surface of the image carrier charged, with light to write a latent image thereon based on image data; a developing device that supplies toner to the latent image and visualizes the latent image; a cleaning device that cleans the surface of the image carrier; a transfer device that transfers an image visualized as a toner image on the surface of the image carrier directly to a recording medium or to the recording medium after the image is transferred to an intermediate transfer element; a fixing device that fixes the toner image on the recording medium; and a lubricant applying device according to above aspects of the present invention.

According to still another aspect of the present invention, in a toner, a volume-average particle size is 10 micrometers or less, and a ratio, being a degree of dispersion, between the volume-average particle size and a number-average particle size is in a range from 1.00 to 1.40.

EFFECT OF THE INVENTION

According to one aspect of the present invention, the frictional coefficient of the surface of the photoconductor can be reduced stably over the whole area where the cleaning unit contacts the photoconductor. Therefore, image formation with high-resolution can be performed by maintaining satisfactory cleaning performance.

According to anther aspect of the present invention, by applying the lubricant to the image carrier, the torque of the image carrier can be reduced, thereby providing an energy-saving machine. Moreover, the drive motor can be minimized, thereby providing a space-saving and low-cost machine.

According to still anther aspect of the present invention, although the cleaning blade, the blade holder, and the lubricant applying device are provided, the whole configuration of the image forming apparatus can be downsized.

According to still anther aspect of the present invention, the lubricant can be efficiently applied to the surface of the photoconductor over the long period of time. Moreover, the consumption amount of lubricant required for maintaining the frictional coefficient of the surface of the photoconductor to a fixed low value, can be reduced.

Furthermore, the lubricant is set on the lower side of the brush roller, and the solid lubricant or the brush roller is caused to sway. Therefore, even if the contact pressure of the solid lubricant against the brush roller is increased to obtain a required application amount of the lubricant, the surface of the solid lubricant, which contacts the brush, does not become irregular caused by its uneven contact with the brush. This allows suppression of fluctuations in the application amount of the lubricant from the initial time to elapsed time.

According to still anther aspect of the present invention, the transfer device in which the blade is not rolled-in at the initial stage can be provided. The process cartridge and the image forming apparatus according to the present invention can provide excellent images without the abnormal images due to cleaning failure of the photoconductor.

EXPLANATIONS OF LETTERS OR NUMERALS

| | |
|---|---|
| 1 | photoconductor |
| 2 | charging device |
| 2a | charging roller |
| 2b | charge cleaning element |
| 3 | lubricant applying device |
| 3a | brush roller |
| 3b | solid lubricant |
| 3c | pressing element |
| 3d | lubricant holding element |
| 3e | lubricant smoothing blade |
| 3f | housing |
| 4 | developing device |
| 8 | cleaning device |
| 8a | cleaning blade |
| 8c | support element |
| 9 | exposing device |
| 11 | side seal |
| 51 | primary transfer rollers |
| 56 | intermediate transfer belt |
| 61 | secondary transfer roller |
| 102Y, 102C, 102M, 102BK | image carrier |
| 128 | cleaning blade |
| 129 | blade holder |
| 131 | lubricant applying device |
| 132 | smoothing blade |
| 134 | solid lubricant |
| 136 | guide |
| C | pressing direction |
| F, G | rotation center |
| H, I | line |

BEST MODE(S) FOR CARRYING OUT THE INVENTION

Exemplary embodiments of the present invention are explained in detail below with reference to the accompanying drawings. It is noted that the present invention is not limited by these embodiments.

Figure 1:
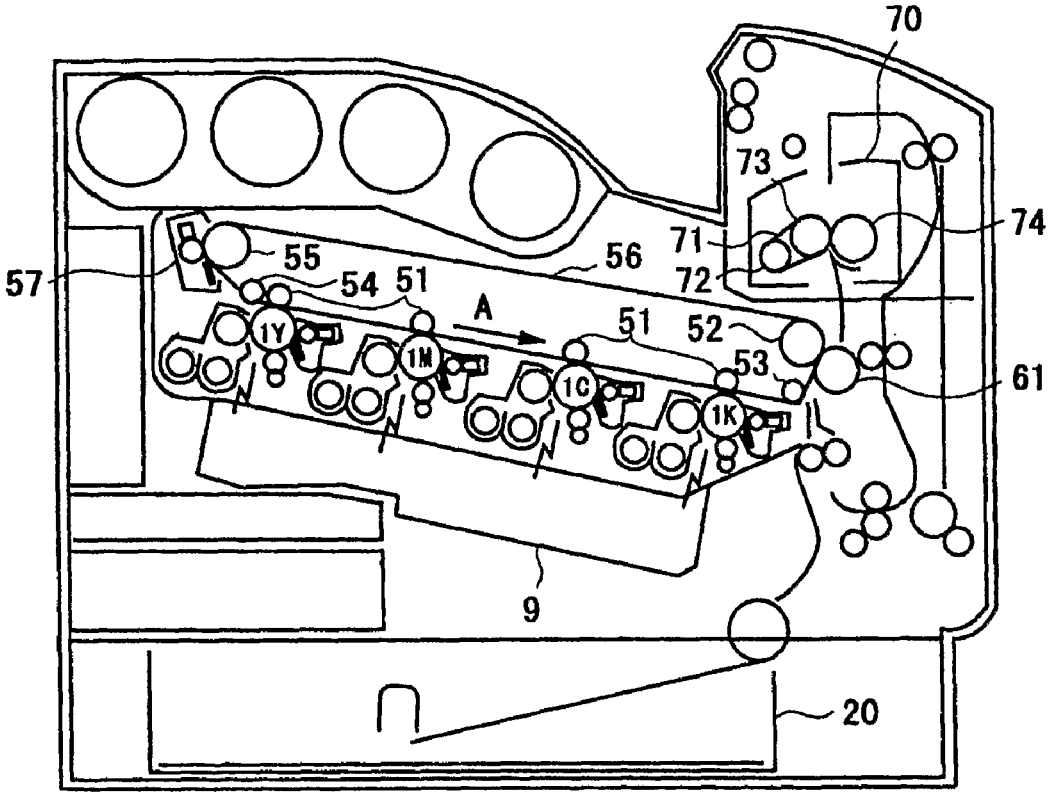
FIG. 1 is a schematic of an image forming apparatus according to an embodiment of the present invention.

FIG. 1 is a schematic diagram of an image forming apparatus according to the present invention.

The image forming apparatus includes an intermediate transfer belt 56 in an almost center thereof. The intermediate transfer belt 56 is an endless belt, which is made of a heat-resistant material such as polyimide and polyamide and includes a base body of which resistance is adjusted to medium resistance. The intermediate transfer belt 56 is supported by four rollers 52, 53, 54, and 55 by being wound around among these rollers, and is made to rotate in the direction of the arrow A. Four imaging units corresponding to colored toners of yellow (Y), magenta (M), cyan (C), and black (K) are aligned under the intermediate transfer belt 56 along the belt surface thereof.

Figure 18:
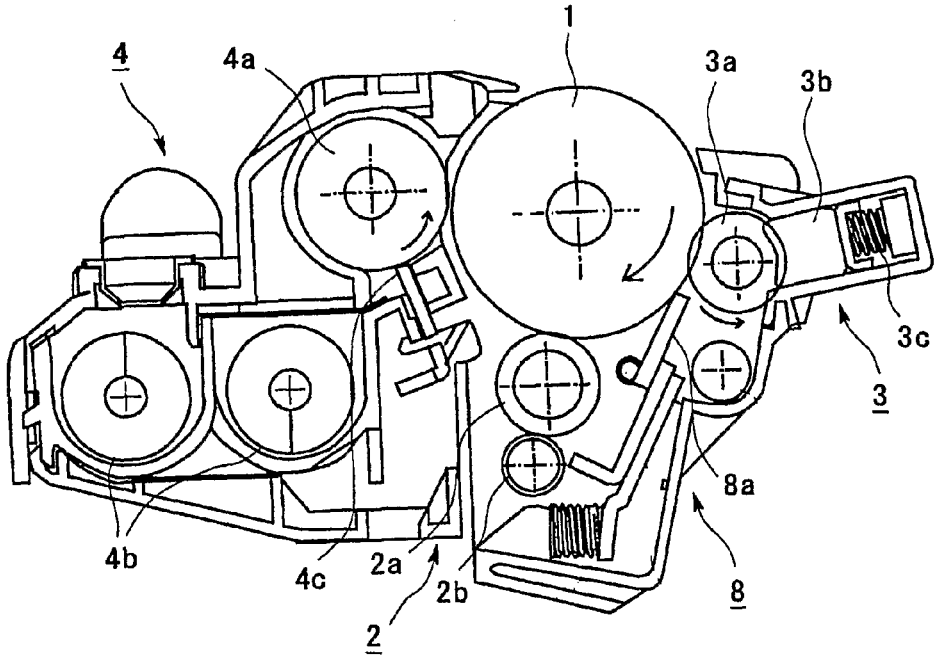
FIG. 18 is a diagram of a lubricant applying device and a cleaning device.

FIG. 18 is an enlarged diagram of one of the four imaging units, and of a conventional applying device, but the configuration thereof is basically the same as that according to present invention, and hence the schematic configuration of FIG. 18 is explained below. Because both the conventional imaging unit and the imaging unit according to the present invention are configured in the same manner, characters Y, M, C, and K indicating discrimination of the colors are omitted in FIG. 18 although the imaging unit includes photoconductors 1Y, 1M, 1C, and 1K in FIG. 1. Arranged around the photoconductor 1 are a charging device 2 that charges the surface of the photoconductor 1, a developing device 4 that develops a latent image formed on the surface of a photoconductor (image carrier) 1 with a colored toner to form a toner image, a lubricant applying device 3 that applies a lubricant to the surface of the photoconductor 1, and a cleaning device 8 that cleans the surface of the photoconductor 1 after the toner image is transferred.

Referring to FIG. 1, an exposing device 9 is provided under the four imaging units. The exposing device 9 exposes the surface of the photoconductor 1 that is charged, based on image data for each color and forms a latent image.

Primary transfer rollers 51 are arranged in positions each facing each photoconductor 1 across the intermediate transfer belt 56, and primarily transfer respective toner images formed on the photoconductors 1 to the intermediate transfer belt 56. The primary transfer roller 51 is connected to a power supply (not shown) and is applied with a predetermined voltage.

A secondary transfer roller 61 is provided outside the portion of the intermediate transfer belt 56 supported by the roller 52 so as to be pressed against the roller 52. The secondary transfer roller 61 is connected to the power supply (not shown) and is applied with a predetermined voltage. A contact portion between the secondary transfer roller 61 and the intermediate transfer belt 56 is a secondary transfer portion, where the toner image on the intermediate transfer belt 56 is transferred to a transfer paper.

An intermediate-transfer-belt cleaning device 57 is provided outside the portion of the intermediate transfer belt 56 supported by the roller 55. The intermediate-transfer-belt cleaning device 57 cleans the surface of the intermediate transfer belt 56 after the secondary transfer is performed.

A fixing device 70 is provided above the secondary transfer portion, and fixes the toner image on the transfer paper semi-permanently. The fixing device 70 includes an endless fixing belt 71 that is wound around between a heating roller 72 and a fixing roller 73, and a pressing roller 74 that is arranged so as to face the fixing roller 73 through the fixing belt 71 and to be pressed against the fixing roller 73. The heating roller 72 includes a halogen heater.

A paper feed device 20 storing sheets of transfer paper is provided in the lower side of the image forming apparatus, and feeds a sheet of transfer paper to the secondary transfer portion.

The features of the image forming apparatus are explained in detail below with reference to FIG. 18.

The photoconductor 1 is an organic photoconductor and has a surface protective layer that is formed with polycarbonate-base resin.

The charging device 2 includes a charging roller 2*a*, being a charging element which is covered with an elastic layer having medium resistance and is provided outside a conductive core metal of the charging roller 2*a*. The charging roller 2*a* is connected to the power supply (not shown) and is applied with a predetermined voltage. The charging roller 2*a* is provided on the photoconductor 1 with a small space between the two. The small space can be set, for example, by winding a spacer element having a fixed thickness around both ends of the charging roller 2*a* which are non-image forming areas, and by bringing each surface of the spacer elements into contact with the surface of the photoconductor 1. A charge cleaning element 2*b* is provided in the charging roller 2*a*, and contacts the surface of the charging roller 2*a* to clean the surface thereof.

The developing device 4 includes a developing sleeve 4*a* that is provided in a position facing the photoconductor 1 and has a magnetic field generator. Provided in the lower side of the developing sleeve 4*a* are two screws 4*b* used to mix toner supplied from a toner bottle (not shown) with a developer and to suck it up to the developing sleeve 4*a* while mixing them. The developer consisting of the toner and magnetic carrier sucked-up by the developing sleeve 4*a* forms a developer layer, of which thickness is restricted to a predetermined value by a doctor blade 4*c*, and the developer is carried on the developing sleeve 4*a*. The developing sleeve 4*a* carries and coveys the developer while rotating in the same direction as the photoconductor 1 at a position opposite thereto, and supplies the toner to the surface of the latent image on the photoconductor 1.

It is noted that the configuration of the developing device 4 of a two-component developing system is shown in FIG. 1, but the configuration is not limited thereto. Therefore, the present invention may also be applicable to even a developing device based on a one-component developing system.

The lubricant applying device 3 includes a solid lubricant 3*b* accommodated in a case that is fixed, and a brush roller 3*a* that contacts the solid lubricant 3*b*, scrapes lubricant off, and applies the lubricant scraped-off to the photoconductor 1. The solid lubricant 3*b* is formed into a rectangular solid and is biased toward the side of the brush roller 3*a* by the pressing element 3*c*. The pressing element 3*c* may be any one of a plate spring, a compressed spring, and the like, and particularly, the compressed spring can be preferably used as shown in FIG. 18. The solid lubricant 3*b* is scraped off by the brush roller 3*a* and consumed, so that its thickness is reduced over time, but since the solid lubricant 3*b* is pressed by the pressing element 3*c*, the solid lubricant 3*b* is always in contact with the brush roller 3*a*. The brush roller 3*a* scrapes the lubricant while rotating, and applies it to the surface of the photoconductor 1.

In the present invention, the lubricant applying device 3 is provided at the outside on the downstream side of the cleaning device 8 as explained below with reference to FIG. 2.

The configuration of the cleaning device 8 according to a first embodiment of the present invention is explained below with reference to FIG. 2.

The cleaning device 8 includes a cleaning blade 8*a* and a support element 8*c*. The cleaning blade 8*a* is formed with plate-like rubber such as urethane rubber and silicone rubber, and is provided so that the edge thereof contacts the surface of the photoconductor 1, thereby removing toner remaining on the photoconductor 1 after a toner image is transferred. The cleaning blade 8*a* and a lubricant smoothing blade 3*e* are bonded to and supported by the support element 8*c* and a support element 3*g*, respectively, which are made of metal, plastic, ceramic, or the like. The cleaning blade 8*a* and the lubricant smoothing blade 3*e* are arranged roughly at each angle as shown in FIG. 2 with respect to the surface of the photoconductor 1, which is explained in detail later.

The lubricant applying device 3 is provided at the outside on the downstream side of the cleaning device 8, and the cleaning blade 8*a* is arranged on the upstream side in the direction of movement of the photoconductor 1 and the lubricant smoothing blade 3*e* is arranged on the downstream side in the same direction as above.

The remaining toner on the surface of the photoconductor 1 is removed by the cleaning blade 8*a*, and the surface thereof is cleaned. The lubricant applying device 3 applies the lubricant to the surface of the photoconductor 1 thus cleaned, and then the lubricant smoothing blade 3*e* slides along the surface thereof to spread the lubricant, thereby forming a thin layer of the lubricant on the surface of the photoconductor 1.

Moreover, the lubricant applying device 3 not only applies the lubricant to the surface of the photoconductor 1 but also can be used as a device that applies the lubricant to the surface of the intermediate transfer belt 56 of FIG. 1. In this case, the lubricant applying device 3 can be arranged next to the intermediate-transfer-belt cleaning device 57, or can be included in the intermediate-transfer-belt cleaning device 57. The lubricant applying device 3 is provided on the upstream side of the intermediate-transfer-belt cleaning device 57 in the direction of movement of the intermediate transfer belt 56, and applies the lubricant to the surface of the intermediate transfer belt 56. The cleaning blade included in the intermediate-transfer-belt cleaning device 57 spreads the lubricant applied, thereby forming a thin layer of the lubricant. Consequently, adherents such as toner can be cleaned satisfactorily. More specifically, the toner remains on the surface of the intermediate transfer belt 56 without being secondarily transferred at a nip portion between the secondary transfer roller 61 and the intermediate transfer belt 56.

Furthermore, a process cartridge integrally supports the lubricant applying device 3, the photoconductor 1, and any unit selected from the charging device 2, the developing device 4, and the cleaning device 8. The process cartridge is detachably mounted on the main unit of the image forming apparatus. If the lubricant applying device 3 is integrated with the cleaning device 8 in the process cartridge, as already explained above, the lubricant applying device 3 is installed on the downstream side of the cleaning blade 8*a* in the movement direction of the photoconductor 1. The process cartridge allows the cleaning performance of the surface of the photoconductor 1 to be maintained over a long period of time and the degradation of image quality to be prevented.

The lubricant applying device 3 is explained below more specifically. FIG. 2 is a partially enlarged diagram of neighborhood of the lubricant applying device 3 according to the first embodiment. The lubricant applying device 3 is provided at outside on the downstream side of the cleaning device 8 for the photoconductor, and includes the solid lubricant 3*b* and the brush roller 3*a* being a brush-like element for applying the solid lubricant 3*b* to the photoconductor 1. The solid lubricant 3*b* is obtained by dissolving a lubricating-oil additive that contains zinc stearate as a main component, and then cooling and solidifying it to be molded into a bar. The solid lubricant 3*b* is held by a lubricant holding element 3*d*, and is pressed against the brush roller 3*a* by a pressing spring fixed to a housing 3*f* of the lubricant applying device 3, through the lubricant holding element 3*d*. The brush roller 3*a* is provided so as to be in contact with the photoconductor 1, and scrapes the solid lubricant 3*b* by rotation of the brush roller 3*a* to be adhered to the brush roller 3*a*. The lubricant adhered to the brush roller 3*a* is applied to the surface of the photoconductor 1 from a contact portion of the brush roller 3*a* with the photoconductor 1. Then, the lubricant is smoothed by the lubricant smoothing blade 3*e*.

As the solid lubricant 3*b*, a dry solid hydrophobic lubricant can be used, and zinc stearate and other components including a stearic acid group as follows can be used, that is, barium stearate, lead stearate, iron stearate, nickel stearate, cobalt stearate, copper stearate, strontium stearate, calcium stearate, cadmium stearate, and magnesium stearate. The dry solid hydrophobic lubricant may also include zinc oleate, manganese oleate, iron oleate, cobalt oleate, lead oleate, magnesium oleate, and copper oleate, which are included in the same fatty acid group; and zinc palmitate, cobalt palmitate, copper palmitate, magnesium palmitate, aluminum palmitate, and calcium palmitate. In addition to these, the dry solid hydrophobic lubricant also includes fatty acids and metal salts of fatty acids such as lead caprylate, lead caproate, zinc linoleate, cobalt linoleate, calcium linoleate, and cadmium ricolinoleate. Furthermore, waxes such as candelilla wax, carnauba wax, rice wax, Japan tallow, jojoba oil, bees wax, and lanoline can be used.

The features of the first embodiment are explained below. In this embodiment, the cleaning blade 8*a*, being a cleaning unit, is made to contact the surface of the photoconductor 1 on the upstream side in the movement direction of the photoconductor 1 with respect to the zone where the lubricant is applied by the brush roller 3*a*. And the lubricant smoothing blade 3*e*, being a lubricant smoothing unit, is made to contact the surface of the photoconductor 1 on the downstream side in the direction of its movement with respect to the zone where the lubricant is applied. Furthermore, in the first embodiment, as shown in FIG. 2, the cleaning blade 8*a* is made to contact the surface of the photoconductor 1 in the counter direction, and the lubricant smoothing blade 3*e* is made to contact the surface of the photoconductor 1 in the trailing direction. These cleaning blade 8*a* and lubricant smoothing blade 3*e* are made of rubber that is an elastic body.

The toner image carried on the surface of the photoconductor 1 is transferred to a transfer material, and then the toner remaining thereon is first removed by the cleaning blade 8*a*. Thereby, the surface of the photoconductor 1 becomes clean, and is contacted by the brush roller 3*a*, so that the lubricant is applied to the surface thereof. The surface of the lubricant applied is smoothed to be uniformly spread when passing through the zone where the lubricant contacts the lubricant smoothing blade 3*e* that is provided on the downstream side in the movement direction of the surface of the photoconductor 1, thereby forming a layer of the lubricant having a uniform thickness.

In the image forming apparatus according to the present invention, an "area applied with the lubricant" means an area where the lubricant is spread by the lubricant smoothing blade 3*e* and a lubricant layer having the uniform thickness is formed. The area applied with the lubricant "covers" an "area cleaned by the cleaning blade" or a contact portion of the cleaning blade 8*a* with the photoconductor 1. Consequently, the frictional coefficient of the photoconductor 1 can be reduced stably over the whole area where the cleaning blade 8*a* contacts the photoconductor 1. Even if toner such as polymer toner of which circularity is high (0.95 or higher) and the toner is difficult to be cleaned by the blade, cleaning performance can be kept satisfactory.

In the image forming apparatus according to the present invention, the "area applied with the lubricant", that is, the area where the lubricant is spread by the lubricant smoothing blade 3*e* and the lubricant layer having the uniform thickness is formed, is substantially same as the "area cleaned by the cleaning blade" or the contact portion of the cleaning blade 8*a* with the photoconductor 1. Consequently, the frictional coefficient of the photoconductor 1 can be reduced stably over the whole area where the cleaning blade 8*a* contacts the photoconductor 1, and cleaning performance can be kept satisfactory.

In the image forming apparatus according to the present invention, the cleaning blade 8*a* is provided on the upstream side of the lubricant applying device 3 in the direction of rotation of the photoconductor 1, and the lubricant smoothing blade 3*e* is provided on the downstream side in the same direction as above. Longitudinal widths of these blades in contact with the photoconductor 1 have a relation of "width of applying brush roller"≦"width of lubricant smoothing blade". More specifically, when the width of the lubricant smoothing blade 3*e* is equal to or larger than the width of the brush roller 3*a* of FIG. 2, the whole lubricant applied by the brush roller 3*a* along the longitudinal direction of the photoconductor 1 can be spread by the lubricant smoothing blade 3*e*, to form a layer of the lubricant having the uniform thickness. Accordingly, the charging device 2 can be prevented from contamination due to the lubricant.

In the image forming apparatus according to the present invention, longitudinal widths as follows in contact with the photoconductor 1 have a relation of "width of lubricant"≦"width of applying brush roller". More specifically, when the width of the brush roller 3*a* is equal to or larger than the width of the solid lubricant 3*b* of FIG. 2, the following effect can be obtained.

If the brush is shorter than the lubricant, the lubricant is scraped in a U shape, and both edges of the lubricant touch a brush shaft. Therefore, the lubricant cannot be used to the last portion, and this causes the amount of waste to be increased or causes the bristle length of the brush to be restricted. In this case, if the bristle length of the brush is shorter, then the lubricant is more wasted.

Therefore, the present invention has such a configuration as "width of lubricant"≦"width of applying brush roller", thereby using the lubricant without waste, and hence, there is no need to restrict the bristle length of the brush.

The image forming apparatus according to the present invention has a relation of "width of charged area"≦"width of applied lubricant" in the longitudinal direction of the photoconductor 1. More specifically, when the width of the lubricant smoothing blade 3*e* (FIG. 2) is equal to or larger than the width of the charging roller 2*a* (FIG. 18), the whole range of a contact area of the photoconductor 1 with the charging roller 2*a* is uniformly applied with the lubricant, and the frictional coefficient of the photoconductor 1 can be reduced stably in all over the contact area, thereby obtaining the following effect.

A very small amount of the lubricant that is supposed to be applied to the photoconductor shifts to the surface of the charging roller when the charging roller contacts the photoconductor. Even if the charging roller does not contact the photoconductor, it may also shift thereto by the action of the electric field. If the adhesion amount of the lubricant to the surface of the charging roller due to the shift is not uniform on the surface of the charging roller, a charge amount (potential) on the photoconductor becomes also nonuniform. By employing the configuration according to the present invention, the lubricant is uniformly applied over the whole range of the contact area of the photoconductor 1 with the charging roller 2*a*, and the amount of lubricant shifted to the surface of the charging roller does not become nonuniform in the axial direction of the charging roller, which allows stable charging.

In the first embodiment, the cleaning blade 8*a* is used to clean the surface of the photoconductor 1, but instead of the cleaning blade 8*a*, a cleaning brush may be used. The cleaning brush is obtained by applying bias to a conductive brush having a resistance between a medium resistance and a low resistance.

However, the present invention is not limited by the first embodiment, and is applicable to all devices using the technological principle of the present invention. The photoconductor or the intermediate transfer element may be either the belt shape or the roller shape.

In the image forming apparatus according to the present invention, the frictional coefficient μ on the image carrier 1 is set to 0.4 or less. If μ is greater than 0.4, occurrence of the filming cannot be sufficiently prevented.

Figure 4:
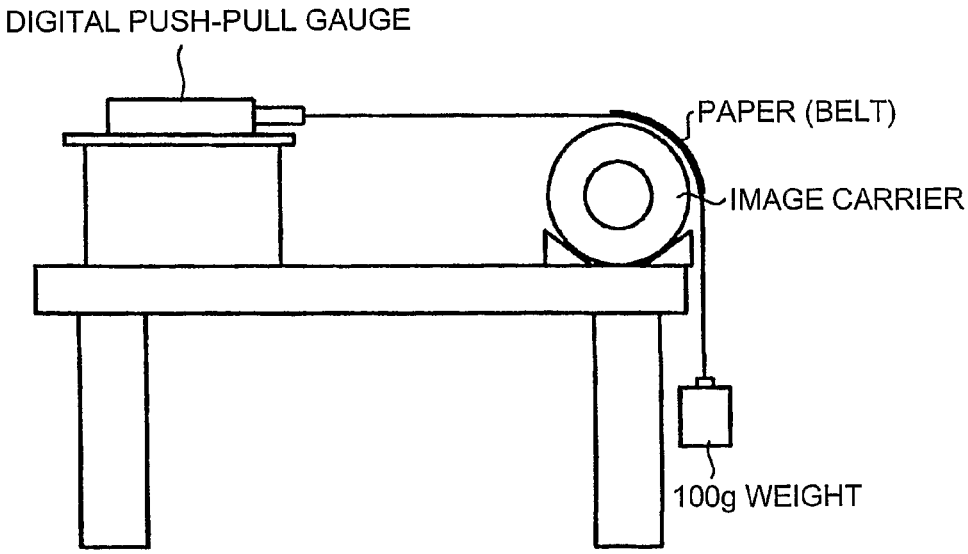
FIG. 4 is a diagram for explaining how to measure a frictional coefficient of a photoconductor.

The frictional coefficient of the photoconductor 1 was measured by using an Euler belt method in the following manner. FIG. 4 is a diagram for explaining how to measure a frictional coefficient of the photoconductor 1. In this case, good quality paper with a medium thickness is used as a belt. This paper is suspended around ¼ of a drum circumference of the photoconductor 1 so that the paper is set in its longitudinal direction, and a weight of, for example, 0.98 N (100 gr) is suspended at one end of the belt, and a force gauge (digital push-pull gauge) is provided at the other end thereof. The force gauge is pulled, and when the belt moves, the weight is read to calculate a frictional coefficient by substituting the weight read in an equation: frictional coefficient $\mu=2/\pi\times 1n(F/0.98)$ (where μ: static frictional coefficient, F: measured value). The frictional coefficient of the photoconductor 1 is a value when the photoconductor 1 enters into a steady state after image formation. This is because the frictional coefficient of the photoconductor 1 is affected by another device also provided in the image forming apparatus, and hence the value, out of other values, of the frictional coefficient immediately after image formation changes first. However, after image formation of about 1,000 sheets of A4 recording paper, the value of the frictional coefficient becomes an almost fixed value. Therefore, the frictional coefficient mentioned here is a frictional coefficient when the frictional coefficient becomes a fixed value in this steady state.

Figure 3:
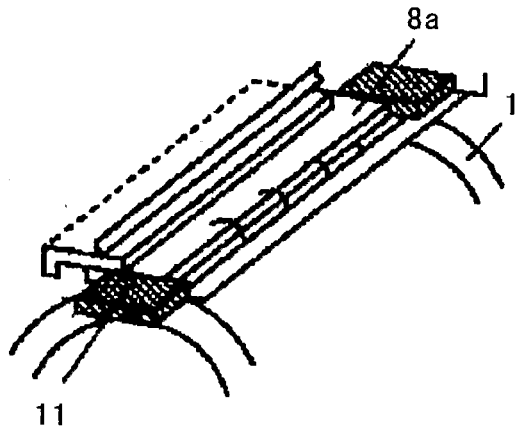
FIG. 3 is a schematic of a side seal of the cleaning device.
Figure 3:
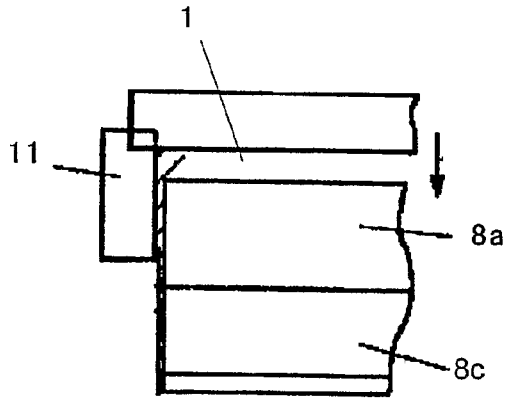

In the image forming apparatus according to the present invention, the cleaning blade has a side seal for preventing toner scattering, and the side seal allows adjustment of an area applied with the lubricant. In FIG. 3, a side seal 11 is provided in both ends of the cleaning blade 8*a* in its width direction to contact the photoconductor 1, and the contact positions of the side seals 11 are adjusted in the longitudinal direction of the photoconductor 1, thereby adjusting the area applied with the lubricant. Therefore, if the lubricant is applied beyond the cleaning area, the area applied with the lubricant can be adjusted only by adjusting the positions of the side seals 11. This allows achievement of the object of the present invention such that the frictional coefficient of the photoconductor is reduced stably over the whole area of the photoconductor which the cleaning blade 8*a* contacts.

Even if the toner as follows is used, satisfactory cleaning capability can be obtained. The toner has a small particle size such that a volume-average particle size of toner particles is 3 to 8 micrometers and a ratio (Dv/Dn) between a volume-average particle size (Dv) and a number-average particle size (Dn) is in a range from 1.00 to 1.40, and has a narrow particle size distribution. By narrowing the particle size distribution of toner particles, a charge amount distribution becomes uniform, thereby obtaining a high quality image with less background fogging, and increasing a transfer rate. Such toner of a small particle size is difficult to be cleaned by the conventional blade method because the cleaning force does not exceed the adhesion force of the toner to the photoconductor 1. Furthermore, if toner particles are small sized, the percentage of external-additive particles in the toner particles tends to be relatively high, and hence, the external-additive particles easily drop out from the toner particles, which causes filming to occur on the photoconductor 1. However, by using the cleaning device 8 of the present invention, the brush roller 3*a* applies the lubricant to the surface of the photoconductor 1 to reduce the frictional coefficient of the photoconductor 1, and the cleaning blade 8*a* blocks the toner particles, to prevent them from their slipping through the cleaning blade 8*a*, thereby improving the cleaning performance.

Furthermore, the present invention is suitable for cleaning of spherical toner. The spherical toner particle can be defined by values of the shape factor SF-1 and the shape factor SF-2 as follows. The toner particles used in the image forming apparatus of the present invention are such that the shape factor SF-1 is from 100 to 180 and the shape factor SF-2 is from 100 to 180.

Figure 5A:
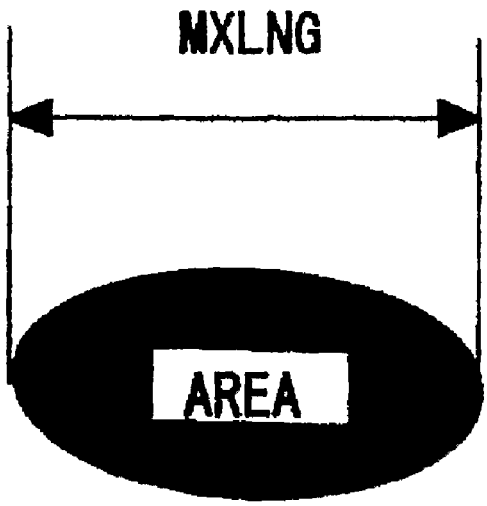
FIG. 5A is a schematic diagram of a toner shape (1) for explaining a shape factor SF-1.
Figure 5B:
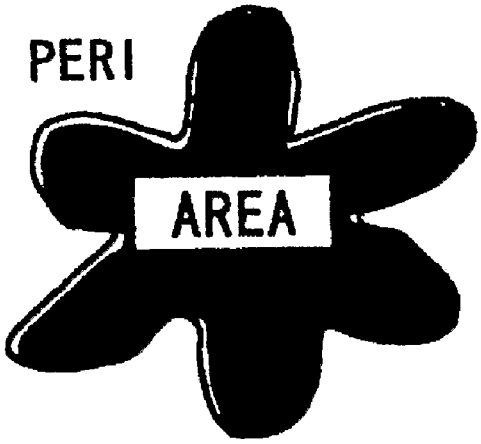
FIG. 5B is a schematic diagram of a toner shape (2) for explaining a shape factor SF-2.

FIG. 5A and FIG. 5B are schematic diagrams of toner shapes for explaining the shape factor SF-1 and the shape factor SF-2. The shape factor SF-1 represents the degree of sphericity of a toner shape, and is expressed by the following expression (1). The shape factor SF-1 is a value obtained by dividing the square of a maximum length MXLNG of a shape, which is obtained by projecting a toner particle onto a two-dimensional plane, by its graphics area AREA, and by multiplying the quotient by 100 π/4.

$$SF\text{-}1=\{(MXLNG)2/\mathrm{AREA}\}\times(100\pi/4) \quad (1)$$

If the value of SF-1 is 100, the shape of toner becomes perfect sphericity, and the shape becomes more and more irregular as the value of SF-1 rises.

The shape factor SF-2 represents the degree of irregularities of a toner shape, and is expressed by the following expression (2). The shape factor SF-2 is a value obtained by dividing the square of a peripheral length PERI of a shape, which is obtained by projecting a toner particle onto a two-dimensional plane, by its graphics area AREA, and by multiplying the quotient by 100 π/4.

$$SF\text{-}2=\{(PERI)^2/\mathrm{AREA}\}\times(100\pi/4) \quad (2)$$

If the value of SF-2 is 100, the surface of toner has no irregularities, and the surface becomes more and more irregular as the value of SF-2 rises.

The shape factor was measured specifically by photographing a toner particle with a scanning electron microscope (S-800: manufactured by Hitachi Ltd.), introducing the photograph into an image analyzer (LUZEX3: manufactured by Nireco Corp.), and analyzing and calculating it.

If the toner has a high sphericity, a contact between a toner particle and a toner particle or between a toner particle and the photoconductor 1 becomes a point contact, which causes an attracting force between the toner particles to get weak. Therefore, fluidity becomes higher as the attracting force gets weaker. The attracting force between a toner particle and the photoconductor 1 also gets weak, and as a result, a transfer ratio becomes high. As explained above, the spherical toner is easy to cause cleaning failure in the cleaning using the blade method, but by using the cleaning device 8 according to the present invention, satisfactory cleaning can be performed. If the SF-1 and the SF-2 are too large, toner scatters over an image, and image quality is thereby degraded, and hence, it is preferable that the SF-1 and the SF-2 do not exceed 180.

The shape of the toner according to the present invention is substantially spherical, and can be expressed by the following shape definition.

Figure 6A:
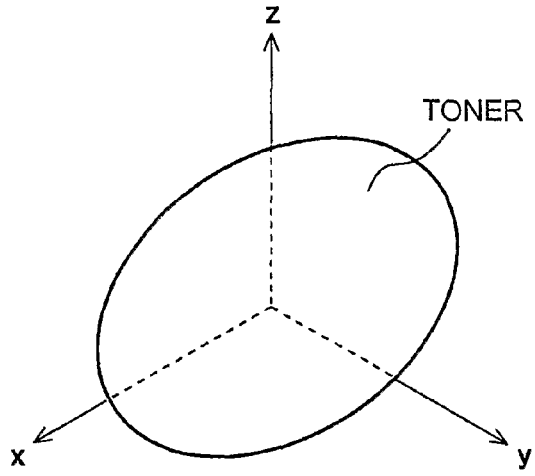
FIG. 6A is a schematic diagram of a toner shape according to the present invention.
Figure 6B:
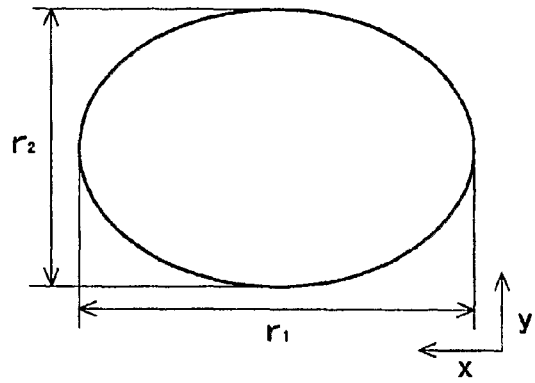
FIG. 6B is a schematic diagram of the toner shape according to the present invention.
Figure 6C:
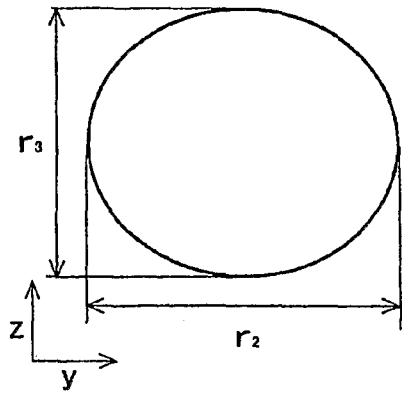
FIG. 6C is a schematic diagram of the toner shape according to the present invention.

FIG. 6A, FIG. 6B, and FIG. 6C are schematic diagrams of the shape of the toner according to the present invention. As shown in FIG. 6A to FIG. 6C, assume that a substantially spherical toner is defined by a major axis r1, a minor axis r2, and a thickness r3 (where r1≧r2≧r3). The toner particle according to the present invention preferably ranges as follows: a ratio between the minor axis and the major axis (r2/r1) (see FIG. 6B) ranges from 0.5 to 1.0, and a ratio between the thickness and the minor axis (r3/r2) (see FIG. 6C) ranges from 0.7 to 1.0. If the ratio between the minor axis and the major axis (r2/r1) is less than 0.5, the toner shape is not close to the perfect sphericity, and hence, dot reproducibility and transfer efficiency are degraded, and a high quality image cannot be obtained. If the ratio between the thickness and the minor axis (r3/r2) is less than 0.7, the toner shape is close to a flat shape, and hence, a high transfer rate as that of the spherical toner cannot be obtained. Particularly, if the ratio between the thickness and the minor axis (r3/r2) is 1.0, the toner becomes a "rotating body" with its major axis as a rotational axis, thereby improving the fluidity of toner.

The r1, r2, and r3 were measured by observing and photographing a toner particle with a scanning electron microscope (SEM) while changing an angle of a visual field.

The toner adequately used in the image forming apparatus according to the present invention is obtained by allowing a toner material solution to undergo crosslinking reaction and/or elongation reaction in an aqueous medium. More specifically, the toner material solution is obtained by dissolving or dispersing at least a polyester prepolymer having a functional group that contains nitrogen atoms, a polyester, a colorant, and a release agent, in an organic solvent. Materials of and a method of manufacturing toner are explained below.

Modified Polyester:

The toner of the present invention contains modified polyester (i) as a binder resin. The modified polyester (i) means a bond group other than ester bonds exists in polyester resin, or in which resin components of which structure is different are bonded by covalent bond or ionic bond in polyester resin. More specifically, the modified polyester (i) is a functional group such as an isocyanate group that reacts with a carboxylic acid group and a hydroxyl group is introduced to polyester end, and is made to react with an active-hydrogen-containing compound to modify the polyester end.

Examples of the modified polyester (i) include a urea-modified polyester obtained by reaction between an isocyanate group-containing polyester prepolymer (A) and an amine group (B), and the like. Examples of the isocyanate group-containing polyester prepolymer (A) include reaction products of a polyester with a polyisocyanate compound (PIC), and the like. More specifically, the polyester is a polycondensation product between a polyhydric alcohol (PO) and a polycarboxylic acid (PC), and has an active hydrogen group. Examples of the active hydrogen group of the polyester are hydroxyl groups such as an alcoholic hydroxyl group and a phenolic hydroxyl group, an amino group, a carboxyl group, a mercapto group, and the like. Among them, the alcoholic hydroxyl group is preferred.

The urea-modified polyester is produced in the following manner.

Examples of polyhydric alcohol compounds (PO) include dihydric alcohol (DIO) and trihydric or more alcohols (TO); and dihydric alcohol (DIO) alone or a mixture of dihydric alcohol (DIO) with a small amount of trihydric alcohol (TO) is preferable. Examples of dihydric alcohol (DIO) include alkylene glycol (e.g. ethylene glycol, 1,2-propylene glycol, 1,3-propylene glycol, 1,4-butanediol, and 1,6-hexanediol); alkylene ether glycols (e.g. diethylene glycol, triethylene glycol, dipropylene glycol, polyethylene glycol, polypropylene glycol, and polytetramethylene ether glycol); alicyclic diols (e.g. 1,4-cyclohexane dimethanol, and hydrogenated bisphenol A); bisphenols (e.g. bisphenol A, bisphenol F, and bisphenol S); adducts of alkylene oxide of the alicyclic diols (e.g. ethylene oxide, propylene oxide, and butylene oxide); and adducts of alkylene oxide of the bisphenols (e.g. ethylene oxide, propylene oxide, and butylene oxide). Among these, alkylene glycol having a carbon number from 2 to 12 and the adducts of alkylene oxides of the bisphenols are preferable. Particularly preferable are the adducts of alkylene oxides of the bisphenols, and a combination of the adducts of alkylene oxides of the bisphenols and alkylene glycol having a carbon number from 2 to 12. Trihydric or more alcohols (TO) include trihydric to octahydric alcohols and more aliphatic alcohols (e.g. glycerol, trimethylolethane, trimethylolpropane, pentaerythritol, and sorbitol); trivalent or more phenols (e.g. trisphenol PA, phenol novolak, and cresol novolak); and adducts of alkylene oxides of the trivalent or more polyphenols.

Examples of a polyvalent carboxylic acid (PC) include a divalent carboxylic acid (DIC) and a trivalent or more carboxylic acid (TC). The divalent carboxylic acid (DIC) alone and a mixture of the divalent carboxylic acid (DIC) and a small amount of the trivalent or more carboxylic acid (TC) are preferable. Examples of divalent carboxylic acids (DIC) include alkylene dicarboxylic acids (e.g. succinic acid, adipic acid, and sebacic acid); alkenylene dicarboxylic acids (e.g. maleic acid and fumaric acid); and aromatic dicarboxylic acids (e.g. phthalic acid, isophthalic acid, terephthalic acid, and naphthalene dicarboxylic acid). Among these, the alkenylene dicarboxylic acids having a carbon number from 4 to 20 and the aromatic dicarboxylic acids having a carbon number from 8 to 20 are preferred. Examples of trivalent or more carboxylic acids (TC) include aromatic polyvalent carboxylic acids having a carbon number from 9 to 20 (e.g. trimellitic acid and pyromellitic acid). The polyvalent carboxylic acid (PC) may be reacted with polyhydric alcohol (PO) using acid anhydrides of these or lower alkyl esters (e.g. methyl ester, ethyl ester, and isopropyl ester).

A ratio between the polyhydric alcohol (PO) and the polyvalent carboxylic acid (PC) is usually from 2/1 to 1/1, preferably from 1.5/1 to 1/1, more preferably from 1.3/1 to 1.02/1, as an equivalent ratio of [OH]/[COOH] between a hydroxyl group [OH] and a carboxyl group [COOH].

Examples of polyvalent isocyanate compounds (PIC) are aliphatic polyvalent isocyanates (e.g. tetramethylene diisocyanate, hexamethylene diisocyanate, and 2,6-diisocyanate methyl caproate); alicyclic polyisocyanates (e.g. isophorone diisocyanate and cyclohexylmethane diisocyanate); aromatic diisocyanates (e.g. tolylene diisocyanate and diphenylmethane diisocyanate); aromatic aliphatic diisocyanates (e.g., $\alpha,\alpha,\alpha',\alpha'$-tetramethylxylylene diisocyanate); isocyanates; compounds formed by blocking these polyisocyanates by a phenol derivative, an oxime, and a caprolactam; and a combination of at least two of these.

A ratio of the polyvalent isocyanate compounds (PIC) is usually from 5/1 to 1/1, preferably from 4/1 to 1.2/1, and more preferably from 2.5/1 to 1.5/1, as an equivalent ratio of [NCO]/[OH] between an isocyanate group [NCO] and a hydroxyl group [OH] of a hydroxyl group-containing polyester. When [NCO]/[OH] exceeds 5, the low-temperature fixing property gets worse. In a case of using urea-modified polyester, the urea content in the ester becomes low when a molar ratio of [NCO] is less than 1, and hot offset resistance deteriorates.

The content of the polyvalent isocyanate compound (PIC) in the isocyanate group-containing polyester prepolymer (A) ranges usually from 0.5 wt. % to 40 wt. %, preferably from 1 wt. % to 30 wt. %, and more preferably from 2 wt. % to 20 wt. %. If the content of the polyvalent isocyanate compound is less than 0.5 wt. %, the hot offset resistance deteriorates, and it is unfavorable from the viewpoint of compatibility of heat resistant preservability and low-temperature fixing property. On the other hand, if the content of the polyvalent isocyanate compound exceeds 40 wt. %, the low-temperature fixing property gets worse.

The number of isocyanate groups contained in one molecule of the isocyanate group-containing polyester prepolymer (A) is usually at least 1, preferably, an average of 1.5 to 3, and more preferably, an average of 1.8 to 2.5. If the isocyanate group per molecule is less than 1, then the molecular weight of the urea-modified polyester becomes low and the hot offset resistance deteriorates.

Further, amines (B) that are reacted with the polyester prepolymer (A) include divalent amine compounds (B1), trivalent or more amine compounds (B2), amino alcohols (B3), amino mercaptans (B4), amino acids (B5), and the compounds (B6) of B1 to B5 in which their amino groups are blocked.

Examples of the divalent amine compounds (B1) include aromatic diamines (e.g. phenylene diamine, diethyl toluene diamine, and 4,4'-diaminodiphenyl methane); alicyclic diamines (e.g. 4,4'-diamino-3,3'-dimethyldicyclohexylmethane, diamine cyclohexane, and isophorone diamine); and aliphatic diamines (e.g. ethylene diamine, tetramethylene diamine, and hexamethylene diamine). Examples of the trivalent or more amine compounds (B2) include diethylene triamine and triethylene tetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6), in which the amino groups of B1 to B5 are blocked, include ketimine compounds obtained from the amines of B1 to B5 and ketones (e.g. acetone, methyl ethyl ketone, and methyl isobutyl ketone), and oxazolidine compounds. The preferable amines among the amines (B) are B1 and a mixture of B1 with a small amount of B2.

A ratio of amines (B) is usually 1/2 to 2/1, preferably 1.5/1 to 1/1.5, and more preferably 1.2/1 to 1/1.2 as an equivalent ratio of [NCO]/[NHx] between an isocyanate group [NCO] in the isocyanate group-containing polyester prepolymer (A) and an amine group [NHx] in the amines (B). When [NCO]/[NHx] exceeds 2 or is less than ½, the molecular weight of the urea-modified polyester becomes smaller, resulting in deterioration in hot offset resistance.

Moreover, an urethane bond may be contained together with an urea bond in the urea-modified polyester. A molar ratio of the urea bond content and the urethane bond content ranges usually from 100/0 to 10/90, preferably from 80/20 to 20/80, and more preferably from 60/40 to 30/70. If the molar ratio of the urea bond is less than 10%, the hot offset resistance deteriorates.

The modified polyester (i) used in the present invention is manufactured by a one shot method and a prepolymer method. The weight-average molecular weight of the modified polyester (i) is usually not less than 10,000, preferably 20,000 to 10,000,000, and more preferably 30,000 to 1,000,000. The peak molecular weight at this time is preferably 1,000 to 10,000, and when it is less than 1,000, the modified polyester (i) is not easily elongated and the elasticity of toner is low, resulting in deterioration in the hot offset resistance. When it exceeds 10,000, tasks in manufacturing such as reduction of fixing property, smaller particle, and pulverization are more difficult to achieve. A number-average molecular weight of the modified polyester (i) is not particularly limited when a native polyester (ii) explained later is used, and the number-average molecular weight should be one which is easily obtained to get a weight-average molecular weight. When the modified polyester (i) is used alone, the number-average molecular weight is usually 20,000 or less, preferably 1,000 to 10,000, and more preferably 2,000 to 8,000. When the number-average molecular weight exceeds 20,000, the low-temperature fixing property deteriorates and the glossiness also deteriorates when used for full-color apparatus.

A reaction inhibitor is used as required for crosslinking reaction between a polyester prepolymer (A) and amines (B) to obtain the modified polyester (i) and/or elongation reaction, thereby adjusting the molecular weight of the urea-modified polyester obtained. Examples of the reaction inhibitor include monoamines (e.g., diethylamine, dibutylamine, butylamine, and laurylamine), and compounds (ketimine compounds) in which the monoamines are blocked.

Native Polyester:

In the present invention, the modified polyester (i) can be used alone, and also a native polyester (ii) can be contained together with (i) as a binder resin component. By using (i) in combination with the native polyester (ii), the low-temperature fixing property is improved and the glossiness is also improved when used for full-color apparatus, which is more preferable than a single use of (i). Examples of the native polyester (ii) include polycondensation of polyhydric alcohol (PO) and polyvalent carboxylic acid (PC), similarly to the polyester component of (i), and preferred compounds are also the same as (i). The native polyester (ii) may be not only a native polyester but also modified one through a chemical bond other than an urea bond, for example, (ii) may be modified with an urethane bond. It is preferable that at least parts of (i) and (ii) are compatible with each other, from viewpoint of low-temperature fixing property and hot offset resistance. Therefore, polyester components of (i) and (ii) have preferably similar compositions. A weight ratio between (i) and (ii) when (ii) is contained is usually 5/95 to 80/20, preferably 5/95 to 30/70, more preferably 5/95 to 25/75, and particularly preferably 7/93 to 20/80. When the weight ratio of (i) to (ii) is less than 5%, the hot offset resistance deteriorates, and this becomes disadvantageous in respect of compatibility between heat resistant preservability and low-temperature fixing property.

The peak molecular weight of (ii) is usually 1,000 to 10,000, preferably 2,000 to 8,000, and more preferably 2,000 to 5,000. When it is less than 1,000, heat resistant preservability deteriorates, and when it exceeds 10,000, low-temperature fixing property deteriorates. A hydroxyl value of (ii) is preferably 5 or more, more preferably 10 to 120, and particularly preferably 20 to 80. When it is less than 5, it becomes disadvantageous in respect of compatibility between the heat resistant preservability and the low-temperature fixing property. An acid value of (ii) is preferably 1 to 5, and more preferably 2 to 4. Since a wax having a high acid value is used, the binder is a low acid value binder that leads to charging and high volume resistance. Therefore, the binder is suitable for the toner used in a two-component developer.

A glass transition point (Tg) of binder resin is usually set to be 35° C. to 70° C., and preferably 55° C. to 65° C. If Tg is less than 35° C., the heat resistant preservability of toner deteriorates. On the other hand, if Tg exceeds 70° C., the low temperature fixing property becomes insufficient. An urea-modified polyester is likely to be on the surfaces of obtained toner base particles. Therefore, the toner according to the present invention tends to show better heat resistant preservability as compared with known polyester toner, even if the glass transition point is low.

Colorant:

All known dyes and pigments are available for a colorant, and the followings and mixtures thereof can be used: for example, carbon black, nigrosine dye, iron black, naphthol yellow S, Hansa yellow (10G, 5G, G), cadmium yellow, yellow iron oxide, yellow ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, and lithopone. The content of the colorant is usually 1 wt. % to 15 wt. %, and preferably 3 wt. % to 10 wt. % in toner particles.

The colorant can also be used as a master batch mixed with resin. Examples of binder resin used to manufacture such a master batch or to be kneaded with the master batch include styrenes such as polystyrene, poly-p-chlorostyrene, polyvinyltoluene, and substituted polymer thereof, or copolymer of these compounds and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic or alicyclic hydrocarbon resin, aromatic petroleum resin, chlorinated paraffin, and paraffin wax. These materials can be used alone or as a mixture thereof.

Charge Control Agent:

Known charge control agents can be used as a charge control agent, and include, for example, nigrosine dyes, triphenylmethane dyes, chromium-containing metal complex dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives. More specific examples of the charge control agents are Bontron 03 as nigrosine dyes, Bontron P-51 as quaternary ammonium salts, Bontron S-34 as metal-containing azo dyes, E-82 as oxynaphthoic acid type metal complex, E-84 as salicylic acid metal complex, E-89 as phenol type condensate (these are manufactured by Orient Chemical Industries, Ltd.), TP-302 and TP-415 as quaternary ammonium salt molybdenum complexes (manufactured by Hodogaya Chemical Industries, Ltd.), Copy Charge PSY VP2038 as quaternary ammonium salt and Copy Charge NX VP434 as quaternary ammonium salt (these are manufactured by Hoechst Co., Ltd.), LRA-901 and LR-147 as boron complex (manufactured by Japan Carlit Co., Ltd.), copper phthalocyanine, perylene, quinacridone, azo type pigments, and polymer compounds having a functional group such as a sulfonic acid group, a carboxyl group, and a quaternary ammonium salt group. Among these, a material that controls the toner to have negative polarity is preferably used.

The use amount of the charge control agent is determined depending on the type of binder resins, presence or absence of additives to be used as required, and a method of manufacturing toner including a dispersion method, and hence, it is not uniquely limited. However, the charge control agent is used preferably in a range from 0.1 to 10 parts by weight (wt. parts), and more preferably from 0.2 to 5 wt. parts, per 100 wt. parts of the binder resin. If it exceeds 10 wt. parts, the toner is charged too highly, which causes effects of the charge control agent to be decreased, electrostatic attracting force with a developing roller to be increased, fluidity of the developer to be lowered, and image density to be reduced.

Release Agent:

A wax having a low melting point in a range from 50° C. to 120° C. effectively functions as a release agent between a fixing roller and a toner boundary in dispersion with binder resin. Due to this effective functioning of the wax, there is no need to apply a release agent as oil to the fixing roller and the high temperature offset is improved. Such wax components include the followings. Examples of waxes include waxes from plants such as carnauba wax, cotton wax, wood wax, and rice wax; waxes from animals such as beeswax and lanolin; waxes from mineral substances such as ozokerite and cercine; and petroleum waxes, such as paraffin, microcrystalline, and petrolatum. Examples of waxes apart from these natural waxes include synthetic hydrocarbon waxes such as Fischer-Tropsch wax and polyethylene wax; and synthetic waxes such as ester, ketone, and ether. In addition to these, a crystalline polymer of which side chain has long alkyl group can be also used. The crystalline polymer includes homo polymer or copolymer of polyacrylate such as poly-n-stearyl methacrylate and poly-n-lauryl methacrylate (for example, n-stearyl acrylate-ethyl methacrylate copolymer), which are aliphatic amide such as 12-hydroxy stearamide, stearic acid amide, phthalic anhydride imide, and chlorinated hydrocarbon; and crystalline polymer resin having low molecular weight.

The charge control agent and the release agent can be fused and mixed with the master batch and the binder resin, and may be added to organic solvent at a time of dissolution and dispersion.

External Additive:

Inorganic fine particles are preferably used as an external additive to facilitate fluidity, developing performance, and chargeability of toner particles. Such an inorganic fine particle has preferably a primary particle diameter of $5\times10^{-3}$ to 2 micrometers. In particular, the primary particle diameter is preferably $5\times10^{-3}$ to 0.5 micrometer. A specific surface area by the BET method is preferably 20 to 500 $m^2/g$. The use ratio of the inorganic fine particles is preferably 0.01 wt. % to 5 wt. % in toner particles, and more preferably 0.01 wt. % to 2.0 wt. %.

Specific examples of the inorganic particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride. Among these materials, hydrophobic silica particles and hydrophobic titanium oxide particles are preferably used in combination as a fluidizing agent. In particular, when both particles having an average diameter of $5\times10^{-2}$ micrometers or less are mixed, electrostatic force and Van der Waals force with toner particles are significantly improved. As a result, even if such external additives are mixed with toner particles in a developing device to achieve a desired charge level, "firefly" (spot)-free desirable image quality can be obtained without desorption of the fluidizing agent from toner particles, and further an amount of remaining toner after a toner image is transferred can be reduced.

While titanium oxide fine particles are excellent in environmental stability and image density stability, the titanium oxide fine particles tend to exhibit degradation in charge rising property. As a result, if an addition amount of titanium oxide fine particles is more than that of silica fine particles, this adverse effect becomes more influential. However, if hydrophobic silica particles and hydrophobic titanium oxide particles are added within 0.3 wt. % to 1.5 wt. %, desired charge rising property is obtained without significant damage to the charge rising property. In other words, even if an image is repeatedly copied, stable image quality can be obtained.

A toner manufacturing method is explained below. Here, exemplary embodiments of the toner manufacturing method are explained below, but the present invention is not limited to these embodiments.

Toner Manufacturing Method:

1) Toner material solution is produced by dispersing a colorant, a native polyester, an isocyanate group-containing polyester prepolymer, and a release agent in organic solvent.

From the viewpoint of easy removal after formation of toner base particles, it is preferable that the organic solvent be volatile and have a boiling point of less than 100° C. More specifically, the followings can be used solely or in combination with two or more types thereof, such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. In particular, aromatic solvent such as toluene and xylene, and halogenated hydrocarbon such as methylene chloride, 1,2-dichloroethane, chloroform, and carbon tetrachloride are preferred. The use amount of organic solvent is usually 0 to 300 wt. parts for 100 wt. parts of polyester prepolymer, preferably 0 to 100 wt. parts, and further preferably 25 to 70 wt. parts.

2) The toner material solution is emulsified in aqueous medium in the presence of a surfactant and resin fine particles.

Such aqueous medium may be water alone or contain organic solvent such as alcohol (e.g. methanol, isopropyl alcohol, and ethylene glycol), dimethyl formamide, tetrahydrofuran, cellosolves (e.g. methyl cellosolve), and lower ketones (e.g. acetone, methyl ethyl ketone).

The use amount of the aqueous medium for 100 wt. parts of the toner material solution is usually 50 to 2,000 wt. parts, and preferably 100 to 1,000 wt. parts. If the amount is less than 50 wt. parts; the toner material solution is poorly dispersed, and it is thereby impossible to obtain toner particles having a predetermined particle size. On the other hand, if the amount exceeds 20,000 wt. parts, this is economically inefficient.

Further, to improve the dispersion in the aqueous medium, a dispersing agent such as a surfactant and resin fine particles are added as required.

Examples of the surfactant are anionic surfactants such as alkyl benzene sulfonate, α-olefin sulfonate, and ester phosphate; amine salts such as alkyl amine salts, aminoalcohol fatty acid derivatives, polyamine fatty acid derivatives, and imidazoline; cationic surfactants of quaternary ammonium salt types such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants such as fatty acid amide derivatives and polyhydric alcohol derivatives; and ampholytic surfactants such as alanine, dodecyl di(aminoethyl)glycine, di(octylaminoethyl)glycine, N-alkyl-N, and N-dimethyl ammonium betaine.

Furthermore, a surfactant having a fluoroalkyl group is used to achieve a desired effect with a very small amount thereof. Preferable examples of anionic surfactants having a fluoroalkyl group are fluoroalkyl carboxylic acids having a carbon number from 2 to 10 and their metal salts; disodium perfluorooctane sulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid and its metal salts; perfluoroalkyl carboxylic acid (C7 to C13) and its metal salts; perfluoroalkyl (C4 to C12) sulfonic acid and its metal salts, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salts, perfluoroalkyl (C6 to C10)-N-ethylsulfonyl glycine salts, monoperfluoroalkyl (C6 to C16) ethyl phosphoric acid esters.

Examples of trade names are SURFLON S-111, S-112, and S113 (manufactured by Asahi Glass Co., Ltd.), FLUORAD FC-93, FC-95, FC-98, and FC-129 (manufactured by Sumitomo 3M Co., Ltd.), UNIDINE DS-101 and DS-102 (manufactured by Daikin Industries, Ltd.), MEGAFACE F-110, F-120, F-113, F-191, F-812, and F-833 (manufactured by Dainippon Ink & Chemicals, Inc.), EKTOP EF-102, 103, 104, 105, 112, 123A, 123B, 306A, 501, 201, and 204 (manufactured by Tochem Products Co., Ltd.), and FTERGENT F-100 and F150 (manufactured by Neos Co., Ltd.).

Examples of cationic surfactants are aliphatic primary, secondary, or tertiary amine containing a fluoroalkyl group, aliphatic quaternary ammonium salt such as ammonium salt of perfluoroalkyl (C6-C6) sulfonamide propyl trimethyl; benzalkonium salts, benzethonium chloride, pyridinium salts, and imidazolinium salts. Trade names thereof are SURFLON S-121 (manufactured by Asahi Glass Co., Ltd.), FLUORAD FC-135 (manufactured by Sumitomo 3M Co., Ltd.), UNIDYNE DS-202 (manufactured by Daikin Industries, Ltd.), MEGAFACE F-150 and F-824 (manufactured by Dainippon Ink & Chemicals, Inc.), EKTOP EF-132 (manufactured by Tochem Products Co., Ltd.), and FTERGENT F-300 (manufactured by Neos Co., Ltd.), or the like.

The resin fine particles may be of any resin selected from thermoplastic resins and thermosetting resins, if an aqueous dispersion may be formed from the resin fine particles. Examples of the resins include vinyl resins, polyurethane resins, epoxy resins, polyester resins, polyamide resins, polyimide resins, silicon resins, phenol resins, melamine resins, urea resins, aniline resins, ionomer resins, and polycarbonate resins. Two or more types of these resins in combination may be used for the resin fine particles.

Among these, vinyl resin, polyurethane resin, epoxy resin, polyester resin, or combination thereof are preferable, since aqueous dispersions of resin spherical fine particles can be easily obtained. Examples of the vinyl resins include resin of polymer in which vinyl monomer is solely polymerized or co-polymerized, such as styrene-methacrylic ester copolymers, styrene-butadiene copolymers, methacrylic acid-acrylic ester copolymers, styrene-acrylonitrile copolymers, styrene-maleic acid anhydride copolymers, and styrene-methacrylic acid copolymers. An average particle size of the resin fine particles is 5 to 200 nanometers, preferably 200 to 300 nanometers.

Moreover, inorganic dispersing agents such as calcium phosphate tribasic, calcium carbonate, titanium oxide, colloidal silica, and hydroxyapatite can also be used.

Dispersion droplets may be stabilized by a high polymer protective colloid as a dispersing agent usable in combination with the resin fine particles and the inorganic dispersing agent. Examples are acids such as acrylic acid, methacrylic acid, α-cyanoacrylic acid, α-cyanomethacrylic acid, itaconic acid, crotonic acid, fumaric acid, maleic acid, or maleic anhydride; or methacrylic monomers containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethylene glycol monoacrylic ester, diethylene glycol monomethacrylic ester, glycerol monoacrylic ester, glycerol monomethacrylic ester, N-methylol acrylamide, N-methylol methacrylamide; vinyl alcohol or ethers with vinyl alcohol such as vinyl methyl ether, vinyl ethyl ether, vinyl propyl ether; or esters of compounds that contains a vinyl alcohol and a carboxyl group such as vinyl acetate, vinyl propionate, vinyl butyrate; acrylamide, methacrylamide, diacetone acrylamide or their methylol compounds; acid chlorides such as chloride acrylate and chloride methacrylate; homopolymers or copolymers of nitrogen-containing compounds such as vinylpyridine, vinylpyrrolidone, vinylimidazole, and ethyleneimine or of heterocyclic ring thereof; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and a cellulose group such as methyl cellulose, hydroxyethyl cellulose, and hydroxypropyl cellulose.

A dispersion method is not particularly limited, and it is possible to use known facilities of a low-speed shearing type, a high-speed shearing type, a friction type, a high-pressure jet type, and an ultrasonic type. Among these, the high-speed shearing type is preferred to obtain dispersed particles having a particle size ranging from 2 to 20 micrometers. When a high-speed shearing type dispersing machine is used, the number of revolutions is not particularly limited, and is usually from 1,000 revolutions per minute (rpm) to 30,000 rpm, preferably from 5,000 rpm to 20,000 rpm. The dispersion time is not particularly limited and is usually from 0.1 to 5 minutes in a batch system. The dispersing temperature is usually from 0° C. to 150° C. (under a pressure), preferably from 40° C. to 98° C.

3) During preparation of an emulsified liquid, amines (B) are added and are allowed to react with polyester prepolymer (A) having an isocyanate group.

This reaction is followed by crosslinking and/or elongation of a molecular chain. The reaction time is selected according to the reactivity between an isocyanate group structure of the polyester prepolymer (A) and amines (B), and is usually 10 minutes to 40 hours, preferably 2 hours to 24 hours. The reaction temperature ranges usually from 0° C. to 150° C., preferably from 40° C. to 98° C. Moreover, a known catalyst can be used if necessary. Specific examples of the catalyst are dibutyl tin laurate and dioctyl tin laurate.

4) After completion of the reaction, the organic solvent is removed from emulsified dispersion (reaction compound), is washed, and dried to obtain the toner base particles.

To remove the organic solvent therefrom, the whole system is gradually heated up while laminar flow is stirred, and is stirred vigorously at a fixed temperature range. The solvent is removed from the dispersion, and then spindle-shaped toner base particles are prepared. Further, if a compound like calcium phosphate salt that can dissolve in an acid or an alkali is used as a dispersion stabilizer, after the calcium phosphate salt is dissolved in an acid like hydrochloric acid, the calcium phosphate salt is removed from the toner base particles by a method of washing. In addition, the calcium phosphate salt can be removed through decomposition by an enzyme.

5) A charge control agent is implanted into the toner base particles thus obtained, and inorganic fine particles such as those of silica and titanium oxide are added externally to obtain the toner.

The implantation of the charge control agent and the external addition of the inorganic fine particles are carried out by a known method using a mixer and so on.

Accordingly, the toner having a small particle size and a sharp particle-size distribution can be obtained easily. Moreover, by vigorously stirring the toner in the process of removing the organic solvent, the shape of, particles can be controlled in a range from a perfectly spherical shape to a spindle shape. Furthermore, the morphology of the surface can also be controlled in a range from a smooth shape to a rough shape.

Figure 2:
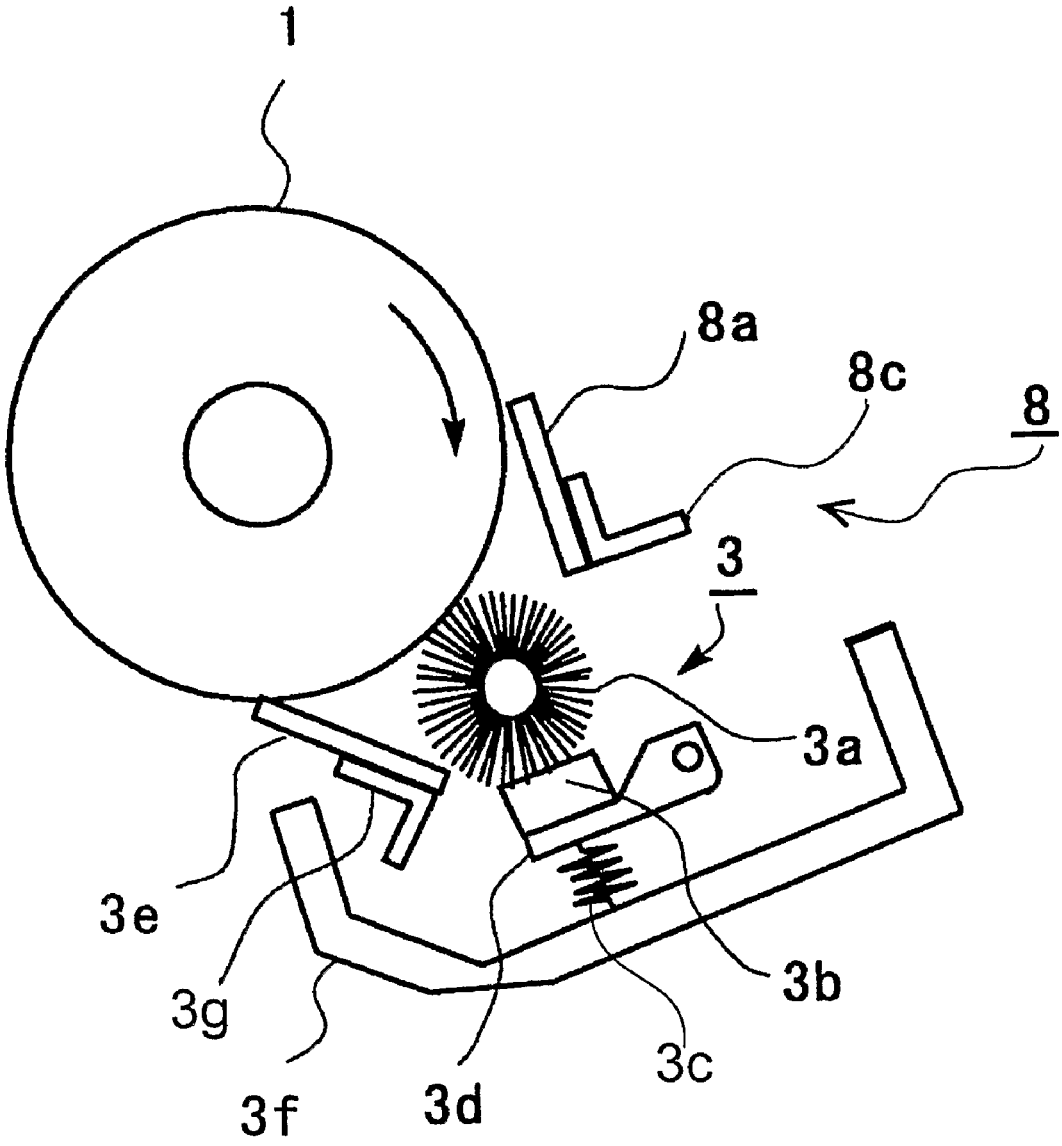
FIG. 2 is a schematic of a lubricant applying device and a cleaning device according to a first embodiment of the present invention.

The configurations of the image forming apparatus, the imaging unit, and the cleaning device according to a second embodiment of the present invention are the same as these in FIG. 1, FIG. 2, and FIG. 18, and hence, explanation thereof is omitted.

In the present invention, the lubricant applying device 3 is disposed inside the cleaning device 8 as explained with reference to FIG. 2. Pressing forces are produced when the solid lubricant 3*b* is pressed against and contacted with the brush roller 3*a* upwardly (from the lower side of the brush) as shown in FIG. 2, when it is pressed against and contacted with the brush roller 3*a* sidewardly (from the side of the brush), or when it is pressed against and contacted with the brush roller 3*a* downwardly (from the upper side of the brush) (not shown). Each of the pressing forces and the deviations of pressing forces between the initial time and the elapsed time (life) (initial pressing force-elapsed time pressing force) are obtained.

TABLE 1

| | | Model G (A4 Machine) | Model J (A3 Machine) |
|---|---|---|---|
| Initial time | Pressing force of spring (mN) | 1480 | 1800 |
| | Own weight of lubricant (mN) | 167 | 363 |
| Elapsed time | Pressing force of spring (mN) | 1140 | 900 |
| | Own weight of lubricant (mN) | 108 | 274 |

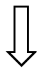

| Pressing direction toward solid lubricant | | | From lower side of brush | From side of brush | From upper side of brush |
|---|---|---|---|---|---|
| Deviation of pressing forces toward lubricant (Initial time - Elapsed time) | Model G (A4 Machine) | (mN) | 281 | 340 | 399 |
| | | (%) | 100 | 121 | 142 |
| | Model J (A3 Machine) | (mN) | 812 | 900 | 988 |
| | | (%) | 100 | 111 | 122 |

It is understood from the table 1 that the pressing force applied to the brush roller 3*a* and the deviation of the pressing forces are different depending on the direction of pressing the solid lubricant 3*b*.

The pressing force and the deviation of the pressing forces in an actual lubricant applying device are explained below. The following two types of machines are used for comparisons. When the solid lubricant 3*b* is pressed downwardly, the deviation of the pressing forces increases by 42% in model G and by 22% in model J as compared with the case where the solid lubricant 3*b* is pressed upwardly.

TABLE 2

| | | |
|---|---|---|
| Initial time | Pressing force of spring | A |
| | Own weight of lubricant | B |
| Elapsed time | Pressing force of spring | C |
| | Own weight of lubricant | D |

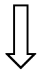

TABLE 2-continued

| Pressing direction toward lubricant | | From lower side of brush | From side of brush | From upper side of brush |
|---|---|---|---|---|
| Pressing direction toward solid lubricant | Initial time | A - B | A | A + B |
| | Elapsed time | C - B | C | C + D |
| Deviation of pressing forces toward lubricant (Initial time - Elapsed time) | | A - B - C + D | A - C | A + B - C - D |

It is understood from the table 2 that the application amount of the lubricant largely fluctuates when the deviation of the pressing force is large because the required application amount of the lubricant is different depending on the models and a multiplier of a pressure spring to be used is different due to restriction to layout, although the magnitudes of the deviation cannot be compared between the models in a simple manner. Therefore, the large fluctuations may lead to an excessive application in the initial stage or to a shortage of application when time is elapsed. Consequently, a smaller deviation of the pressing force allows more stable application.

Accordingly, the arrangement, as shown in FIG. 2, in which the solid lubricant 3*b* is pressed from the lower side of the brush roller 3*a*, allows more stable application of the lubricant as compared with the arrangements in which it is pressed from the side and from the upper side of the brush roller 3*a*.

Figure 7:
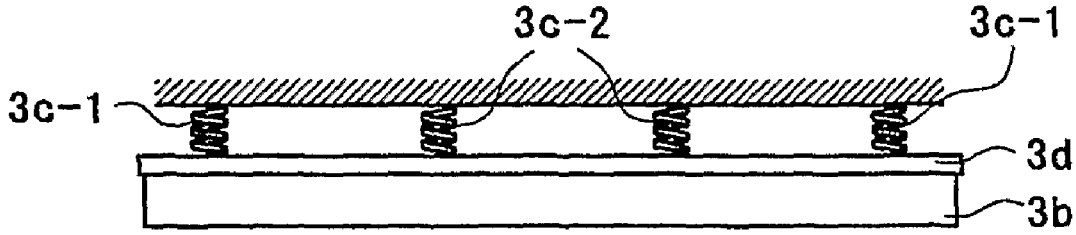
FIG. 7 is a diagram of a solid lubricant for the lubricant applying device when viewed from its longitudinal direction as the front.

FIG. 7 is a diagram of the solid lubricant 3*b* for the lubricant applying device 3, when viewed from its longitudinal direction as the front side.

The solid lubricant 3*b* molded into a rectangular solid is fixed to the lubricant holding element 3*d*. A plurality of pressing elements 3*c*-1 and 3*c*-2 are provided in the lubricant holding element 3*d* so as to be aligned in the longitudinal direction thereof. The pressing elements 3*c*-1 and 3*c*-2 bias the solid lubricant 3*b* toward the side of the brush roller 3*a*. The pressing force of the pressing element 3*c* is adjusted so as to decrease the pressing force of the pressing elements 3*c*-2 provided at a central area as compared with that of the pressing elements 3*c*-1 provided at end areas in the longitudinal direction. When a compressed spring is used as the pressing element 3*c* as shown in FIG. 7, a spring pressure is changed between the pressing element 3*c*-1 and the pressing element 3*c*-2.

The reason that the pressing element 3*c* is provided in plurality and the pressing force is made different between the pressing element 3*c*-1 and the pressing element 3*c*-2 in the above manner is as follows. At first, if there is only one pressing element 3*c*, the lubricant cannot be uniformly applied in the longitudinal direction. If the pressing forces of the pressing elements 3*c* are the same as one another, then the pressing force of the pressing elements 3*c*-1 positioned at the end areas in the longitudinal direction easily escapes to the outside. Therefore, the solid lubricant 3*b* undergoes larger pressure at its central area in the longitudinal direction, which causes nonuniform application of the lubricant. Consequently, the pressing force of the pressing elements 3*c*-2 is controlled to be lower than that of the pressing elements 3*c*-1, to balance the pressures in the longitudinal direction of the solid lubricant 3*b*, and the solid lubricant 3*b* is in contact with the brush roller 3*a* at uniform pressure, thereby achieving uniform application of the lubricant to the surface of the photoconductor 1.

The example of FIG. 7 shows four pressing elements 3*c*, but two or more, preferably three or more of pressing elements 3*c* may be provided in the present invention. If two pressing elements 3*c* are provided, the two are arranged at both ends in the longitudinal direction, and hence, no pressing element 3*c* is provided at the central area. This loses the pressure balance in the longitudinal direction, which causes nonuniform application to occur in the central area in the longitudinal direction of the photoconductor 1. Thus, three or more pressing elements 3*c* are aligned in a row in the longitudinal direction, to take balance over the whole area in the longitudinal direction, thereby enabling further uniform application of the lubricant.

The pressing force of the solid lubricant 3*b* against the brush roller 3*a* is controlled so that the total pressure of the pressing forces of the pressing elements 3*c* (3*c*-1 and 3*c*-2 in FIG. 7) ranges from 200 to 1,000 mN. If the total pressure is less than 200 mN, the brush roller 3*a* cannot sufficiently scrape the solid lubricant 3*b* off, which results in unsatisfactory application amount of the lubricant for the surface of the photoconductor 1. This promotes the wear of the cleaning blade 8*a* and the surface of the photoconductor 1, and cleaning failure such that toner remains after a toner image is transferred easily occurs. If the total pressure exceeds 1,000 mN, the application amount of the lubricant for the surface of the photoconductor 1 becomes too much. This causes consumption of the solid lubricant 3*b* to be quicker, and causes the surface of the photoconductor 1 to be excessively applied with the lubricant that contains hygroscopic fatty acid metal salt, thereby being affected by humidity. This causes an electrostatic latent image to be flowed, which leads to such a failure as occurrence of the image blur. Therefore, the solid lubricant 3*b* is pressed preferably at the total pressure of 200 to 1,000 mN with respect to the brush roller 3*a*.

The thickness of each brush fiber of the brush roller 3*a* is preferably 3 to 8 denials, and the density of brush fibers is preferably 20,000 to 100,000/inch$^2$. If the thickness of the brush fiber is too thin, the bristles become easily bent when the brush roller 3*a* contacts the surface of the photoconductor 1. Conversely, if the brush fiber is too thick, the density of the brush fibers cannot be increased. If the density of the brush fibers is low, the number of brush fibers contacting the surface thereof is small, and hence, the lubricant cannot be uniformly applied to the surface of the photoconductor 1. Conversely, if the density of brush fibers is too high, a gap between a fiber and a fiber becomes narrower, and an adhesion amount of the powder of the lubricant scraped off is reduced, which causes a shortage of the application amount.

The brush roller 3*a* is produced in the range set such that the thickness of the brush fiber is provided so as not to be bent and the density of the brush fibers is provided so as to efficiently perform uniform application of the lubricant.

As shown in FIG. 2, the rotation direction of the brush roller 3*a* is preferably in the forward direction with respect to the movement direction of the photoconductor 1. If the rotation direction of the brush roller 3*a* is in the opposite direction to the movement direction of the photoconductor 1, the powder of the lubricant adhered to the brush fiber of the brush roller 3*a* is scattered by the impact when the brush roller 3*a* contacts the surface of the photoconductor 1, so that the uniform and efficient application cannot be performed. As a result, the rotation direction of the brush roller 3*a* is preferably in the forward direction with respect to the movement direction of the photoconductor 1.

The solid lubricant 3*b* is used in the same manner as that explained in the first embodiment.

Figure 8A:
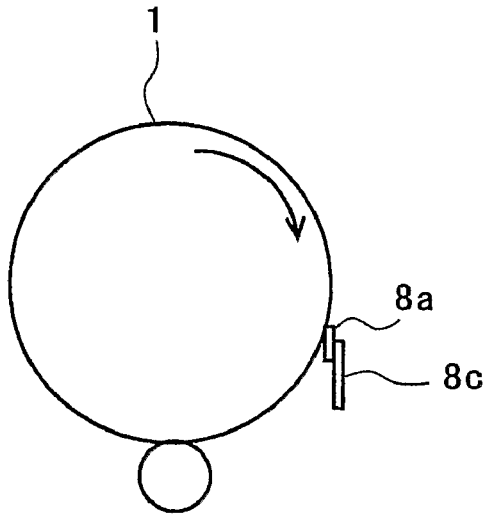
FIG. 8A is a diagram of how a blade contacts the photoconductor (in a counter manner)
Figure 8B:
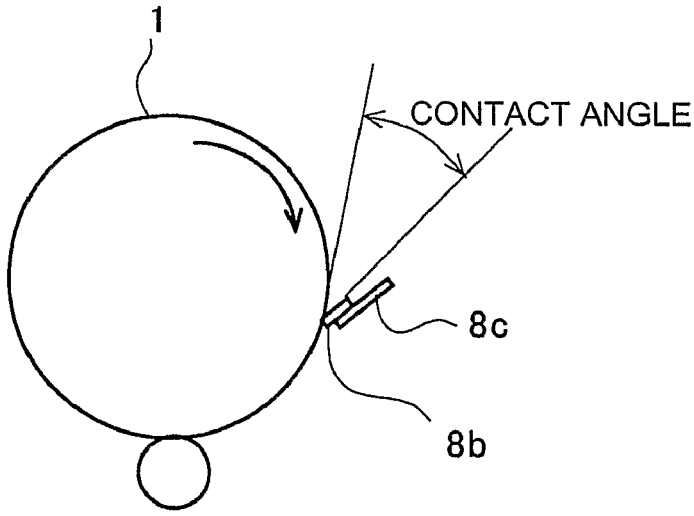
FIG. 8B is another diagram of how a blade contacts the photoconductor (in a trailing manner) and of a contact angle.

Features of the second embodiment are explained below. The cleaning blade 8*a*, being a cleaning unit, is made to contact the surface of the photoconductor 1 on the upstream side in the movement direction of the photoconductor 1 with respect to the zone where the lubricant is applied by the brush roller 3*a*. Then a lubricant smoothing blade 8*b*, being a lubricant smoothing unit, is made to contact the surface of the photoconductor 1 on the downstream side in the movement direction of the photoconductor 1 with respect to the zone where the lubricant is applied. In the second embodiment, as shown in FIG. 8A and FIG. 8B, the cleaning blade 8*a* is made to contact the surface of the photoconductor 1 from the counter direction, and the lubricant smoothing blade 8*b* is made to contact the surface thereof from the trailing direction. The cleaning blade 8*a* and the lubricant smoothing blade 8*b* are made of rubber which is an elastic body.

Based on the configuration above, a toner image carried on the surface of the photoconductor 1 is transferred to a transfer material, and the toner remaining on the surface thereof after the toner image is transferred is first removed by the cleaning blade 8*a*. The surface of the photoconductor 1 becomes clean through the toner removal, and the brush roller 3*a* contacts the surface cleaned and applies the lubricant thereto. The surface of the lubricant applied is uniformly spread when it is passing through the zone, where the lubricant smoothing blade 8*b* contacts the lubricant, which is on the downstream side in the movement direction of the photoconductor 1, to form a layer of the lubricant having a uniform thickness.

The lubricant applying device 3 and the cleaning device 8 thus configured are provided in the image forming apparatus, and an appropriate amount of lubricant is applied to the surface of the photoconductor 1, which allows formation of a uniform thin film of the lubricant without nonuniform application.

After the remaining toner is cleaned in the above manner, the lubricant is applied, and the lubricant applied is smoothed to form a uniform layer, thereby preventing both failures occurring in the cases of the "the cleaning after the application" and the "the application after the cleaning". More specifically, the deviation of the application amount of lubricant and the deviation of the static frictional coefficient of the surface due to the "the cleaning after the application" are prevented to occur. The abnormal images due to a nonuniform lubricant layer caused by "the application after the cleaning" are also prevented to occur. The abnormal images include the worm hole, the image blur, and the rough image. At the same time, the application function of the brush roller 3*a* can also be maintained over the long period of time. Since the rubber is used for the lubricant smoothing blade 8*b*, even if the lubricant smoothing blade 8*b* moves along the photoconductor 1 in its contact state, the surface of the photoconductor 1 is not possibly damaged.

In the present invention, the wear of the cleaning blade 8*a* and the surface of the photoconductor 1 can be prevented, and the toner remaining on the surface thereof after the toner image is transferred can be satisfactorily cleaned even if the spherical and small-sized toner particles are used. Moreover, the image blur can be prevented. The image blur may occur when the surface of the photoconductor 1 is affected by humidity due to excessive application of the lubricant.

In the second embodiment, the surface of the photoconductor 1 is cleaned by the cleaning blade 8*a*, but a cleaning brush may be used instead of the cleaning blade 8*a*. The cleaning brush is obtained by applying bias to a conductive brush having a resistance between a medium resistance and a low resistance.

The present invention is not limited by the embodiments, and is applicable to any device that uses the technological principles of the present invention. The photoconductor or the intermediate transfer element may be either one of a belt shape and a roller shape.

A relation between the torque and the cleaning performance according to the present invention is shown in table 3.

When only the cleaning blade is made to contact the surface of the photoconductor, the torque is 10, but when the lubricant is applied, the torque decreases to 8 even when the lubricant smoothing blade 8*b* contacts the surface thereof. The cleaning performance is not sufficient enough to perform cleaning without the lubricant, but it is improved with the lubricant, and then, the efficient cleaning becomes possible.

TABLE 3

| | Torque level | Torque | Cleaning performance |
|---|---|---|---|
| Only cleaning blade is in contact | 10 | bad | bad |
| Cleaning blade, lubricant, smoothing blade, lubricantv applying element are in contact | 8 | good | good |

The decrease in the torque allows energy saving, and a motor can be minimized to allow low cost and space saving.

Figure 9:
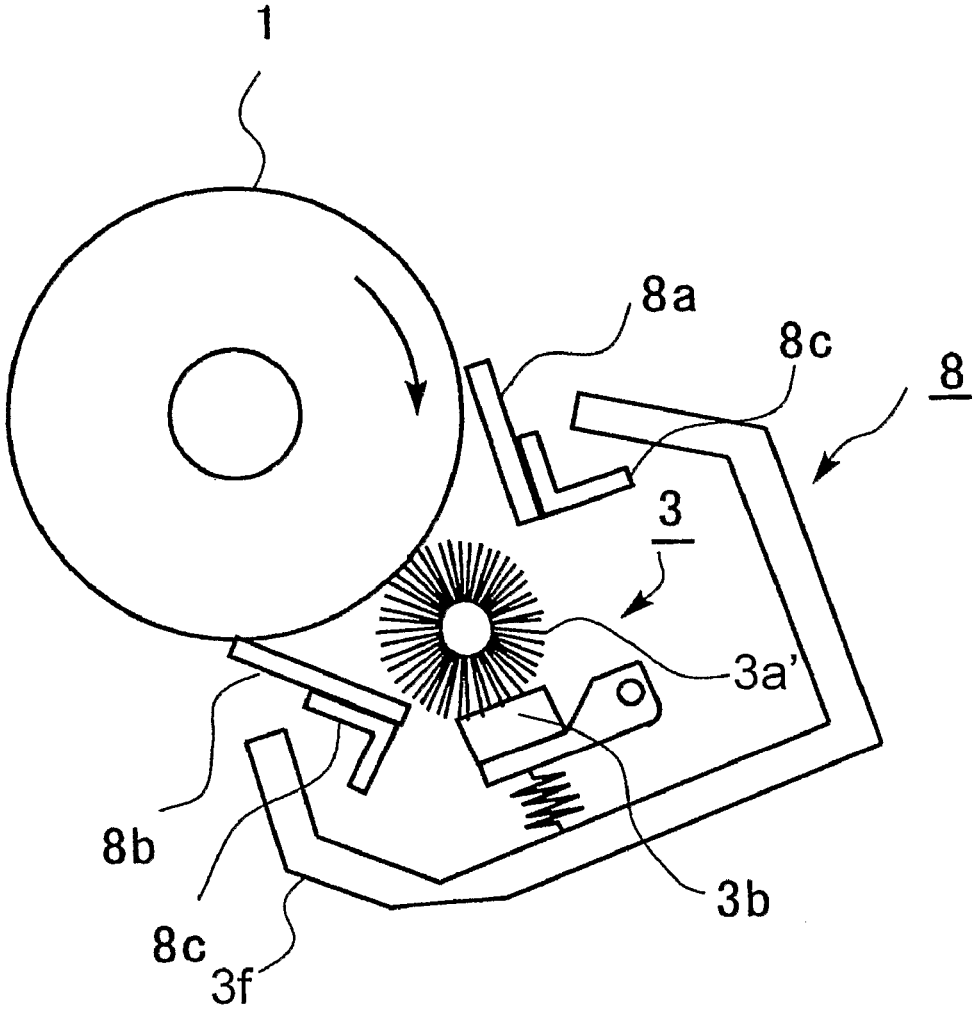
FIG. 9 is a schematic diagram of a lubricant applying device and a cleaning device according to a third embodiment of the present invention.

FIG. 9 is a schematic diagram for explaining a third embodiment of the present invention. A lubricant applying device according to the third embodiment is different from that in FIG. 2. More specifically, in the lubricant applying device of FIG. 2, the applying brush, being a contact type, is used as an applying element. However, in the third embodiment, an applying brush 3*a*' being noncontact with the surface of the photoconductor 1 is used. In this device, a solid lubricant is not used but a powdery lubricant 3*b*' is used. The rotation of the applying brush 3*a*' allows compositions of the lubricant to float, and the compositions are adhered to the surface of the photoconductor 1.

Since the lubricant applying device thus configured applies the lubricant in a noncontact manner, the torque can decrease more than the second embodiment while the cleaning performance the same as that of the second embodiment is maintained. Therefore, further energy saving is achieved, and the motor can be minimized to allow low cost and space saving.

In the third embodiment, tests were conducted by comparing a method according to the present invention with the conventional method. The method according to the present invention was such that the lubricant smoothing blade 8*b* was made to contact the surface of the photoconductor 1 in the trailing manner and the lubricant applied was smoothed. As the result of the testing, the effect of the present invention can be verified.

Effect Verification Test on Present Invention:

Present Invention:

First blade (Cleaning blade) (Upstream side: Counter manner, Blade type: T7240, Thickness: 1.3 mm)

Applying device (Brush type: Insulation polyethylene terephthalate (PET), Pressure to lubricant: 1250 mN×4)

Second blade (Lubricant smoothing blade) (Downstream side: Trailing manner, Blade type: T7240, Thickness: 1.3 mm)

Conventional Method:

First blade (Upstream side: not provided)

Applying device (Brush type: Insulation PET, Pressure to lubricant: 1250 mN×4)

Second blade (Cleaning blade) (Downstream side: Counter manner, Blade type: T7240, Thickness: 1.3 mm)

The lubricant was applied under the conditions as explained above, and comparisons were made on the application amounts of the lubricant required to keep a frictional coefficient of the surface of photoconductor: $\mu=0.2$ under the conditions of image formation in which a rate of an image area of polymer toner is 50%.

Results are as follows:

Present Invention 0.04 g/km

Conventional Method 0.35 g/km

It is verified from the results that the present invention employing the method of '"the application after the cleaning"+smoothing blade' is further highly effective in reduction of the frictional coefficient of the surface of the photoconductor, as compared with the conventional method of "the cleaning after the application".

The following tests were conducted to obtain optimal values of a contact angle and a contact pressure of the second blade, being the lubricant smoothing blade according to the present invention, with respect to the surface of the photoconductor. As the result of the tests, the following conditions which are suitable for implementation of the present invention are obtained.

Test Conditions:

Second blade (Lubricant smoothing blade) (Blade type: T7050, Thickness: 1.3 mm)

Fur brush (Brush type: SA7, No Brush flicker)

Charging roller (No roller, No cleaner)

Pressure to lubricant (Own weight: 36 g)

Contact angle and contact pressure of second blade

Contact angle: 9 degrees (Contact pressure 1400 mN, 2800 mN)

Contact angle: 19.7 degrees (Contact pressure 2200 mN)

Contact angle: 22.7 degrees (Contact pressure 1400 mN, 2800 mN)

The photoconductor unit was made to run idle under the above conditions, and $\mu$ on the surface of the photoconductor was measured at a predetermined time interval. As the result, when the contact angle is 22.7 degrees and the contact pressure is 2800 mN, the frictional coefficient is the minimum (minimum value 0.12, maximum value 0.21), and the vibration of the unit is smaller than other conditions, so that these conditions become the most favorable. From the results, to efficiently reduce the frictional coefficient of the surface of the photoconductor, a larger angle of the blade is better, and a higher contact pressure is better according to the range of the tests.

In the image forming apparatus according to the present invention, the toner used in the developing device 4 preferably has a volume-average particle size ranging from 3 to 8 micrometers, and has a ratio (Dv/Dn) between the volume-average particle size (Dv) and the number-average particle size (Dn) ranging from 1.00 to 1.40.

By using toner particles having a small particle size, the toner particles can be densely adhered to a latent image. However, if the volume-average particle size is smaller than the range of the present invention, and if a two-component developer is used, the toner particles are fused onto the surfaces of magnetic carriers during stirring of the developer for a long time in the developing device, to reduce the charging capability of the magnetic carriers. And if a one-component developer is used, filming of the toner particles to the developing roller easily occurs, and the toner particles are easily fused to an element such as a blade for making the toner thinner. Conversely, if the volume-average particle size is larger than the range of the present invention, it becomes difficult to obtain a high-resolution and high-quality image. When toner particles in the developer are consumed, the balance of toner particle sizes may sometimes largely fluctuate.

By narrowing the particle size distribution, a charge amount distribution of toner becomes uniform, thereby obtaining a high quality image with less background fogging, and increasing a transfer rate. However, when Dv/Dn exceeds 1.40, the charge amount distribution is widened and resolution decreases, which is not preferable.

An average particle size and a particle size distribution of toner particles can be measured using Coulter Counter TA-II and Coulter Multisizer II (both manufactured by Coulter Electronics Limited). In the present invention, the Coulter Counter TA-II was used to measure the average particle size and the size distribution by being connected to an interface (manufactured by Nikkaki Bios Co.) which outputs a number (of particles) distribution and a volume distribution, as well as to a personal computer (PC9801: manufactured by NEC Corp.).

In such toner, a proportion of wax and inorganic fine particles occupied in toner particles is increased as compared with that of conventional toner particles by reducing the toner particle size. The wax is internally or externally added to toner particles to improve the release property, and the inorganic fine particles are used to improve the fluidity. These additives become a factor of adhesion substances (adherents) produced on the photoconductor 1. The lubricant applying device 3 according to the present invention is therefore installed to form a thin film with uniform lubricant over the whole area on the surface of the photoconductor 1, thereby reducing an adhesion force of the adhesion substances to the surface of the photoconductor 1. Furthermore, the frictional force between the surface of the photoconductor 1 and the cleaning blade 8*a* of the cleaning device 8 or the lubricant smoothing blade 8*b* is reduced to enable satisfactory cleaning.

When toner particles used in the developing device 4 have high circularity such as an average circularity of 0.93 or higher, the effect of providing the cleaning device 8 of the present invention in an image forming apparatus is significant. The toner particles having high circularity easily enter the space between the photoconductor 1 and the cleaning blade during cleaning using the blade system, and easily slip through the space. If the contact pressure of the cleaning blade to the photoconductor 1 is increased, the photoconductor 1 is largely damaged. Furthermore, even in a method of applying a bias having opposite polarity to charge polarity of toner, to the brush roller, and electrostatically collecting toner, it is difficult to remove the toner from the brush roller. Therefore, electrostatic toner removal capability tends to decrease gradually.

However, the cleaning device 8 of the present invention allows efficient cleaning of the surface of the photoconductor 1 in the following manner even if the toner particles have high average circularity. More specifically, the toner remaining on the photoconductor 1 is electrostatically collected by an electrostatic cleaning element, and then, the remaining toner is finally scraped off by the cleaning blade 8*a* and removed. Thus, efficient cleaning can be performed without damage to the surface of the photoconductor 1.

The average circularity of toner is a value obtained by optically detecting a particle, projecting the particle onto a plane to obtain an area of the particle projected, and dividing the area by a circumferential length of a circle having an area equivalent to the area of the particle projected. The average circularity is measured actually by using a flow particle image analyzer (FPIA-2000: manufactured by Sysmex Corp.). Water of 100 to 150 milliliters from which impurity solid is previously removed is put into a predetermined container, 0.1 to 0.5 milliliter of surfactant being a dispersing agent is added to the water, and sample to be measured is further added thereto by about 0.1 to 9.5 grams. A suspension with the sample dispersed therein is dispersed for about 1 to 3 minutes by an ultrasonic disperser, and concentration of a dispersing solution is controlled to 3,000 to 10,000 pieces/μL, and the shape and the distribution of toner particles are measured.

The toner used in the image forming apparatus according to the present invention has the shape factor SF-1 ranging preferably from 100 to 180 and the shape factor SF-2 ranging also preferably from 100 to 180. The shape factor SF-1 and the shape factor SF-2 are the same as those explained with reference to FIG. 5.

Further, the constitutional materials and manufacturing method of toner are the same as those explained in the first embodiment, and explanation thereof is omitted.

The molecular weight of a polymer produced with a modified polyester can be measured, using Gel Permeation Chromatography (GPC), with tetrahydrofuran (THF) as a solvent. A glass transition point (Tg) of a native polyester can be measured by a Differential Scanning Calorimeter (DSC).

In the toner manufacturing method, resin fine particles are added to stabilize toner base particles that are formed in the aqueous medium. Therefore, it is preferable that the resin fine particles are added to make 10% to 90% covering over the surface of the toner base particles. Examples of the resin fine particles are fine particles of poly methyl methacrylate having a particle size of 1 micrometer and 3 micrometers; fine particles of polystyrene having a particle size of 0.5 micrometer and 2 micrometers; and fine particles of poly(styrene-acrylonitrile) having a particle size of 1 micrometer. Examples of trade names are PB-200H (manufactured by Kao Corp.), SGP (manufactured by Soken Co., Ltd.), TECHNOPOLYMER-SB (manufactured by Sekisui Plastics Co., Ltd.), SGP-3G (manufactured by Soken Co., Ltd.), and MICROPEARL (manufactured by Sekisui Fine Chemical Co. Ltd.).

The shape of the toner according to the third embodiment is almost spherical as that in the first embodiment. The toner manufactured can be used as magnetic toner, for a one-component developer that does not use magnetic carrier, or as non-magnetic toner.

When the toner is used for a two-component developer, the toner may be mixed with magnetic carrier. The magnetic carrier is ferrite that contains divalent metal such as iron, magnetite, Mn, Zn, and Cu, and its volume-average particle size is preferably 20 to 100 micrometers. If the average particle size is less than 20 micrometers, then the carrier is easily adhered to the photoconductor 1 upon development. If it exceeds 100 micrometers, then carrier is not easily mixed with toner, and the charge amount of toner is not sufficient. Therefore, charging failure easily occurs during continuous use. Zn-containing Cu ferrite is preferred because its saturated magnetization is high, but it can be selected as required according to the process of the image forming apparatus. Resin covering the magnetic carrier is not particularly limited, but includes, for example, the resin includes silicone resin, styrene-acrylic resin, fluororesin, and olefin resin. The manufacturing method of the resin may be either one of methods as follows: a method of dissolving coating resin in a solvent and spraying the solvent into a fluidized bed to coat a carrier core, and another method of electrostatically adhering resin particles to core particles and thermally fusing the resin particles to cover the core particles. The thickness of the core particle covered with resin is 0.05 to 10 micrometers, preferably 0.3 to 4 micrometers.

Figure 10:
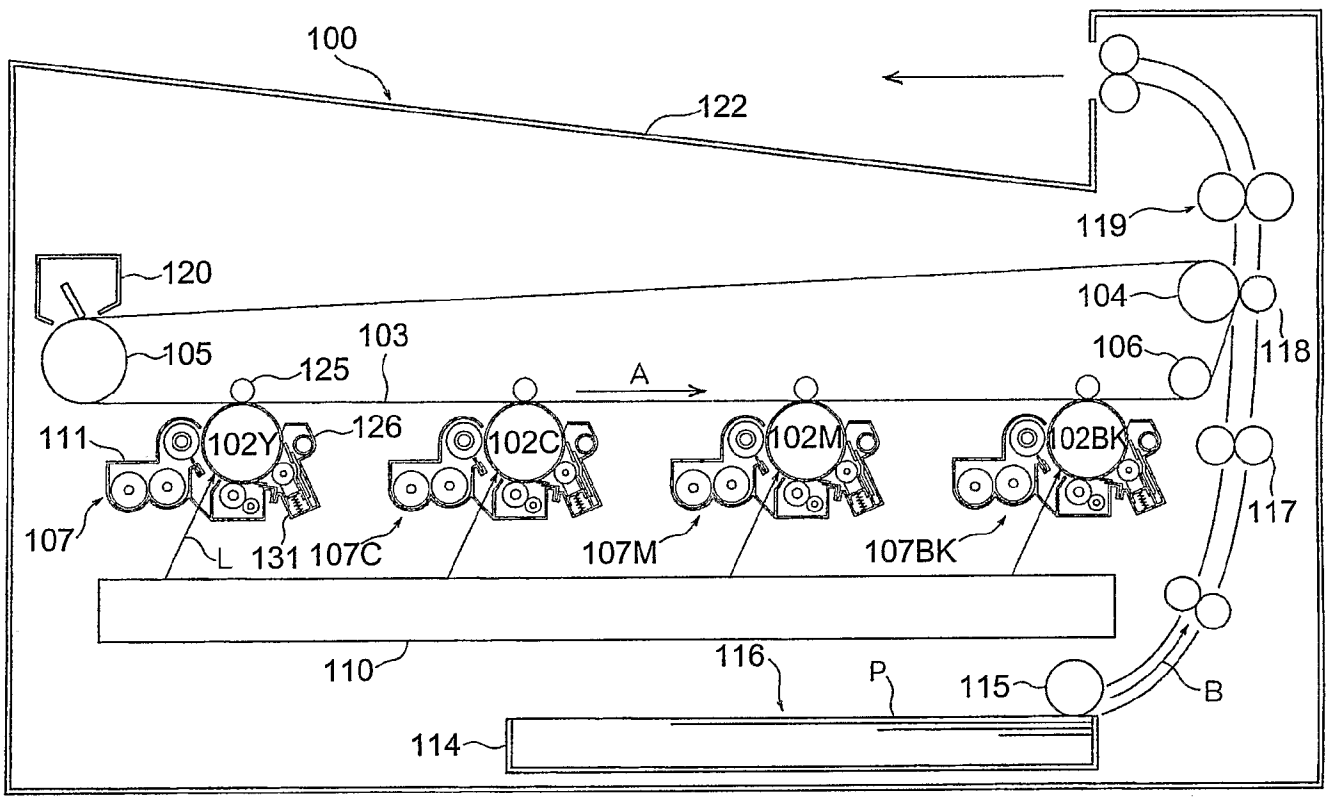
FIG. 10 is a cross-section of one example of an image forming apparatus.

FIG. 10 is a vertical cross-section of one example of an image forming apparatus that can form a full-color image. The image forming apparatus includes an endless intermediate transfer belt 103 that is wound around among a plurality of support rollers 104, 105, and 106 and is made to rotate in the direction of arrow A, and first to fourth process cartridges 107Y, 107C, 107M, and 107BK, which are arranged opposite to the intermediate transfer belt 103. The process cartridges 107Y, 107C, 107M, and 107BK include image carriers 102Y, 102C, 102M, and 102BK, respectively, which are configured as drum-shaped photoconductors that form respective toner images of different colors. The toner images of different colors are formed on the respective image carriers, and are superposedly transferred to the intermediate transfer belt 3. The intermediate transfer belt 103 is one example of a transfer material to which the toner images on the respective image carriers are transferred Reference numeral 100 in FIG. 10 is the main unit of the image forming apparatus.

How to form toner images on the image carriers 102Y, 102C, 102M, and 102BK of the first to fourth process cartridges 107Y, 107C, 107M, and 107BK and to transfer the toner images to the intermediate transfer belt 103 is substantially the same as one another in the respective configurations, although the toner images are formed with different colors. Therefore, only the configuration, in which a toner image is formed on the image carrier 102Y of the first process cartridge 107Y and the toner image formed is transferred to the intermediate transfer belt 103, is explained below.

Figure 11:
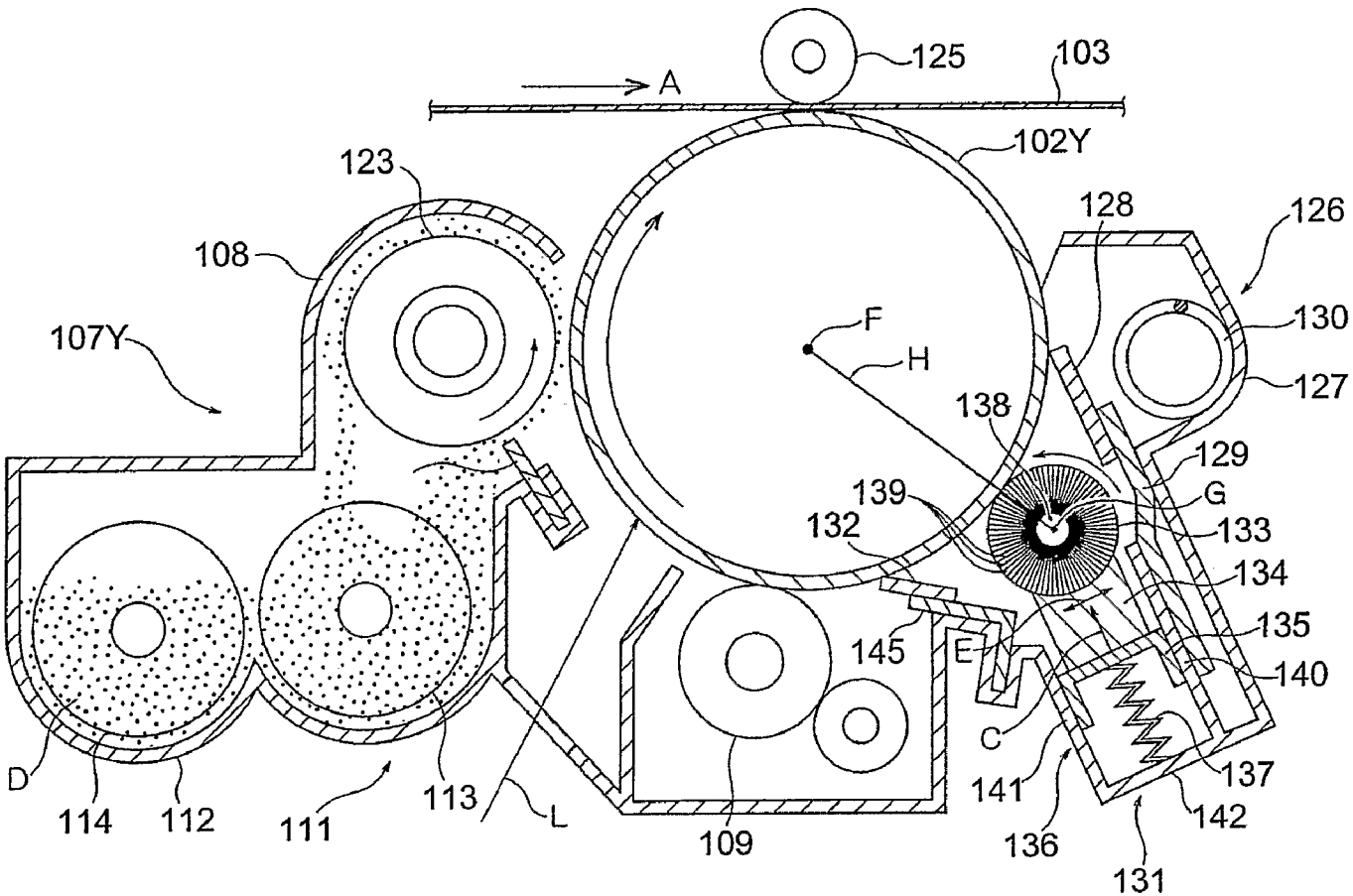
FIG. 11 is an enlarged cross-section of one of process cartridges of FIG. 10.

FIG. 11 is an enlarged cross-section of the first process cartridge 107Y. The image carrier 102Y of the process cartridge 107Y is rotatably supported by a unit case 108, and is made to rotate in the clockwise direction by a drive unit (not shown). When it is rotated, a charging voltage is applied to a charging roller 109 rotatably supported by the unit case 108, so that the surface of the image carrier 102Y is charged to predetermined polarity. Laser light L, which is emitted from an optical writing unit 110 shown in FIG. 10 and optically modulated, is radiated to the image carrier 102Y after being charged, thereby forming an electrostatic latent image on the image carrier 102Y. The electrostatic latent image is visualized as a yellow toner image by a developing device 111.

The developing device 111 includes a developing case 112 that is formed with a part of the unit case 108, and the developing case 112 accommodates a two-component dry-type developer D containing toner and carrier. Disposed in the developing case 112 are two screws 113 and 114 that stir the developer D, and a developing roller 123 that is made to rotate in the counterclockwise direction in FIG. 11. The developer D sucked to the circumferential surface of the developing roller 123 is carried on the circumferential surface thereof and is conveyed in the direction of rotation of the developing roller 123. Then the developer D passing through a doctor blade 124 is conveyed to a developing region between the developing roller 123 and the image carrier 102Y. At this time, the toner in the developer is electrostatically moved to the electrostatic latent image formed on the image carrier 102Y and the latent image is visualized as a toner image. The developer D having passed through the developing region is separated from the developing roller 123 and stirred by the screws 113 and 114. The toner image is formed on the image carrier 102Y in the above manner. A developing device using one-component developer without carrier can also be employed.

On the other hand, a primary transfer roller 125 is arranged on the opposite side to the process cartridge 107Y across the intermediate transfer belt 103. A transfer voltage is applied to the primary transfer roller 125, and the toner image on the image carrier 102Y is thereby primarily transferred to the intermediate transfer belt 103 that is made to rotate in the direction of arrow A. Remaining toner adhered to the image carrier 102Y after the toner image is transferred is removed by a cleaning device 126. The cleaning device 126 according to the third embodiment includes a cleaning case 127 formed with a part of the unit case 108, a cleaning blade 128 of which front edge is pressed against the surface of the image carrier 102Y, a blade holder 129 that holds the cleaning blade 128, and a toner conveying screw 130 disposed in the cleaning case 127. The cleaning blade 128 is arranged in the counter direction with respect to the movement direction of the surface of the image carrier 102Y. Such a cleaning blade 128 is made of an elastic body such as rubber, and the base side of the cleaning blade 128 is fixed to the blade holder 129 with, for example, an adhesive. By pressing the front edge of the cleaning blade 128 against the surface of the image carrier 102Y, the remaining toner on the image carrier 102Y is scraped off and removed. The toner removed is conveyed to the outside of the cleaning case 127 by the toner conveying screw 130 that is made to rotate. The cleaning blade 128 cleans the image carrier after the toner image is transferred to a transfer material (which corresponds to the intermediate transfer belt 103 of FIG. 10).

The process cartridge 107Y also includes a lubricant applying device 131 that applies a lubricant to the image carrier 102Y, and a smoothing blade 132 that is one example of a lubricant smoothing unit for smoothing the lubricant applied to the image carrier 102Y. These devices are explained in detail later.

In the same manner as explained above, a cyan toner image, a magenta toner image, and a black toner image are formed on the second to fourth image carriers 102C, 102M, and 102BK of FIG. 10, respectively. These toner images are primarily transferred, in a sequential superposing manner, to the intermediate transfer belt 103 with the yellow toner image having been transferred thereon, to form a composite toner image on the intermediate transfer belt 103. How to remove the remaining toner on the image carriers 102C, 102M, and 102BK after the respective toner images are transferred is also the same as that of the first image carrier 102Y.

As shown in FIG. 10, a paper feed device 116 is provided in the main unit 100 of the image forming apparatus at the lower side thereof. The paper feed device 116 includes a paper feed cassette 114 for storing recording mediums P such as transfer paper, and a paper feed roller 115. The top-most recording medium P is sent out in the direction of arrow B by rotation of the paper feed roller 115. The recording medium sent-out is fed, at a predetermined time, into a space between a portion of the intermediate transfer belt 103, which is wound around the support roller 104, and a secondary transfer roller 118 which faces the support roller 104 by a registration roller pair 117. At this time, a predetermined transfer voltage is applied to the secondary transfer roller 118, and the composite toner image on the intermediate transfer belt 103 is thereby secondarily transferred to the recording medium P.

The recording medium P with the composite toner image secondarily transferred thereon is further conveyed upwardly to pass through a fixing device 119, where the toner image on the recording medium P is fixed thereon by the action of heat and pressure. The recording medium P having passed through the fixing device 119 is ejected to a paper ejection portion 122 provided on the upper side of the main unit 100 of the image forming apparatus. The remaining toner adhered to the intermediate transfer belt 103 after the toner image is transferred is removed by the cleaning device 120.

The image forming apparatus according to the third embodiment includes the lubricant applying device 131 so that the wear of the cleaning blade 128 and the image carrier 102Y in FIG. 11 is suppressed, and that high cleaning performance by the cleaning blade 128 can be maintained even if the spherical toner having a small particle size is used. The lubricant applying device 131 is also provided in the second to fourth process cartridges 107C, 107M, and 107BK, respectively, and its configuration and performance are perfectly the same as those of the process cartridge 107Y. Therefore, only the lubricant applying device 131 of the process cartridge 107Y shown in FIG. 11 is explained below.

The lubricant applying device 131 of FIG. 11 includes a brush roller 133 that contacts the surface of the image carrier 102Y, a solid lubricant 134 that faces the brush roller 133, a lubricant holder 135 that firmly supports the solid lubricant 134, a guide 136 that guides the solid lubricant 134 through the lubricant holder 135, and a compressed coil spring 137 as one example of the pressing unit.

The brush roller 133 includes a core shaft 138 and a large number of brush fibers 139 whose base portion is fixed to the core shaft 138. The brush roller 133 thus configured extends in almost parallel to and longitudinally along the image carrier 102Y, and both ends of the core shaft 138 in the longitudinal direction are rotatably supported with respect to the unit case 108 via bearings (not shown). During image formation, the brush roller 133 is made to rotate in the counterclockwise direction in FIG. 11.

The solid lubricant 134 is formed into a rectangular solid longitudinally extending in parallel to the brush roller 133. The top surface of the solid lubricant 134 on the side facing the brush roller 133 contacts the brush fibers 139 of the brush roller 133, and the base side of the solid lubricant 134 that is opposite to the top surface is fixed to the lubricant holder 135. The guide 136 according to the third embodiment includes a pair of guide plates 140 and 141 which are spaced in parallel to each other so as to face each other, and the pair of guide plates 140 and 141 is integrated into one unit by a connection plate 142. The pair of guide plates 140 and 141 and the connection plate 142 are formed with a part of the unit case 108.

The lubricant holder 135 is disposed between the pair of guide plates 140 and 141, and slidably contacts the mutually facing sides of the guide plates 140 and 141.

Figure 12:
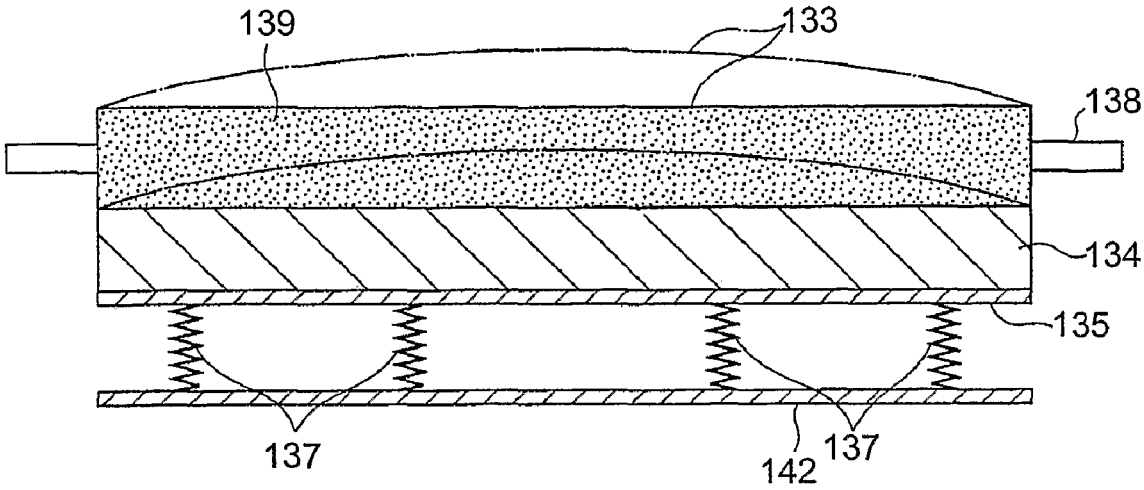
FIG. 12 is a diagram for explaining a relation in arrangement among a brush roller, a solid lubricant, and a compressed coil spring of FIG. 11.

The compressed coil spring 137 is arranged in plurality between the connection plate 142 and the lubricant holder 135 as shown in FIG. 12. The compressed coil springs 137 press the solid lubricant 134 against the brush roller 133 through the lubricant holder 135. The pressing direction is indicated by arrow C in FIG. 11. Instead of the compressed coil spring, a pressing unit such as a twisted coil spring and a plate spring can be used.

The solid lubricant 134 is pressed against the brush fibers 139 of the brush roller 133 in the above manner, and the brush fibers 139 are pressed against the surface of the image carrier 102Y. At this time, the brush roller 133 is rotated, and the lubricant of the solid lubricant 134 is scraped off by the brush fibers 139 to become powdery lubricant, and the powdery lubricant scraped-off is applied to the surface of the image carrier 102Y. As explained above, the brush roller 133 is one example of a lubricant applying element that applies the powdery lubricant scraped-off from the solid lubricant 134 to the surface of the image carrier.

The solid lubricant 134 is scraped by the brush roller 133 and consumed, so that its thickness is reduced over time, but since the solid lubricant 134 is pressed by the compressed coil spring 137, the solid lubricant 134 can be always in contact with the brush fibers 139 of the brush roller 133.

Since the surface of the image carrier 102Y is applied with the lubricant in the above manner, the frictional coefficient of the surface thereof can be suppressed to low. The wear of the image carrier 102Y and the cleaning blade 128 can thereby be minimized, and their lives can be prolonged. Moreover, even if the spherical toner having a small particle size is used, large reduction in cleaning performance of the image carrier 102Y by the cleaning blade 128 can be prevented.

Furthermore, the guide 136 is provided in the lubricant applying device 131 according to the third embodiment. The guide 136 guides the lubricant holder 135 and the solid lubricant 134 so that these two can move substantially only in a direction of approaching or separating from the brush roller 133, namely, in a pressing direction C of the compressed coil spring 137 and in the opposite direction thereto. Therefore, the solid lubricant 134 does not largely sway in a direction E, which is perpendicular to the pressing direction C. Consequently, the solid lubricant 134 is capable of contacting the brush roller 133 along almost the same area at any time, and an almost fixed amount of lubricant can be fed to the surface of the image carrier through the brush roller 133, thereby preventing nonuniform application of the lubricant to the surface of the image carrier.

Figure 14A:
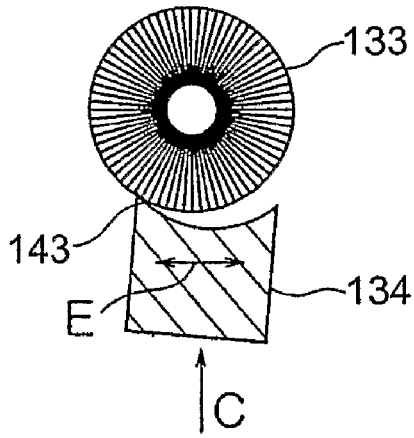
FIG. 14A is a diagram for explaining a faulty example (1) when a guide for the solid lubricant is not provided.
Figure 14B:
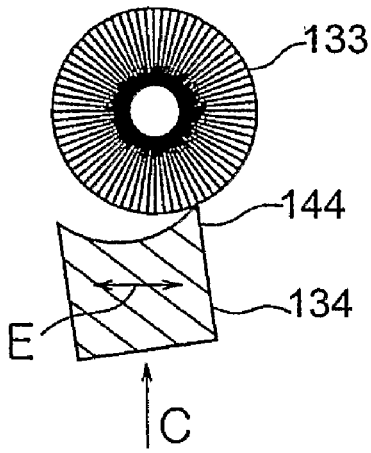
FIG. 14B is a diagram for explaining another faulty example (2) when the guide for the solid lubricant is not provided.

If the guide 136 is not provided, as shown in FIG. 14A and FIG. 14B, the solid lubricant 134 largely sways in the direction E perpendicular to the pressing direction C of the compressed coil spring. Therefore, only a portion 143 or a portion 144 of the surface of the solid lubricant 134 that faces the brush roller 133 contacts the brush roller 133, or the whole of the surface contacts the brush roller 133. Thus, the lubricant is not uniformly applied to the image carrier 102Y, which may lead to degradation of the toner image transferred to the intermediate transfer belt 103 and of the image quality of a final image formed on the recording medium P. The image forming apparatus according to the third embodiment allows prevention of such failure.

In the image forming apparatus shown in FIG. 10, the lubricant holder 135 contacts the pair of guide plates 140 and 141, and the solid lubricant 134 is guided by the guide 136 through the lubricant holder 135. However, the solid lubricant 134 can be also configured to be guided directly by the guide 136. The solid lubricant 134 is guided by the guide 136 so that the solid lubricant 134 can move substantially only in the direction C in which the solid lubricant 134 approaches or separates from the brush roller 133. This indicates, however, that the solid lubricant 134 may sway along the direction E, which is perpendicular to the direction C, by a slight amount of allowance.

As explained above, the lubricant applying device 131 according to the third embodiment includes a lubricant applying element that is the brush roller 133 which contacts the image carrier 102Y while rotating, the solid lubricant 134 disposed in a location facing the lubricant applying element, the guide 136 that guides the solid lubricant 134 so that the solid lubricant 134 can move substantially only in the direction of approaching or separating from the brush roller 133, and the pressing unit that includes the compressed coil spring 137 for pressing the solid lubricant 134 against the lubricant applying element.

Figure 15:
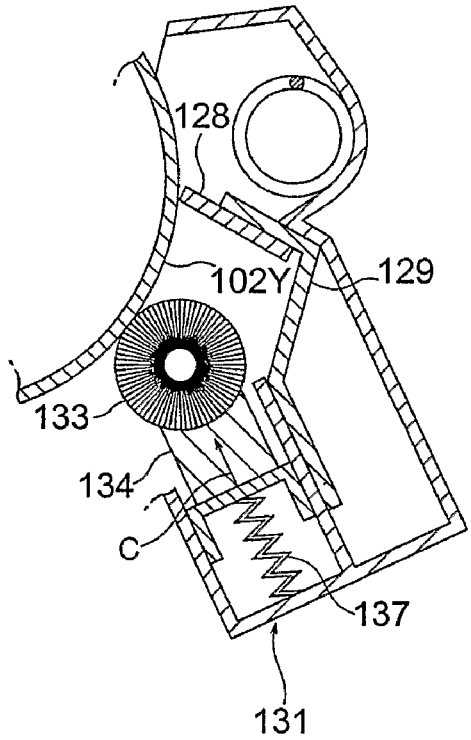
FIG. 15 is a diagram for explaining faulty when a pressing direction of the compressed coil spring and a protruding direction of the cleaning blade are not parallel to each other.

Moreover, as shown in FIG. 11, the positions of the compressed coil spring 137 and the cleaning blade 128 are respectively set so that the direction C in which the compressed coil spring 137 presses the solid lubricant 134 against the brush roller 133 is almost parallel to the direction in which the cleaning blade 128 is protruded toward the surface of the image carrier 102Y. Therefore, the space occupied by the cleaning blade 128, the blade holder 129, and the lubricant applying device 131 in the main unit of the image forming apparatus can be reduced, thereby downsizing the image forming apparatus. As shown in FIG. 15, if the pressing direction C is not parallel to the direction in which the cleaning blade 128 is protruded toward the surface of the image carrier 102Y, the whole of the cleaning blade 128, the blade holder 129, and the lubricant applying device 131 occupies a large space around the image carrier 102Y, and this large space inevitably causes upsizing of the image forming apparatus. The image forming apparatus according to the third embodiment can avoid this disadvantage with simple configuration.

Furthermore, as shown in FIG. 11, in the image forming apparatus according to the third embodiment, the blade holder 129 is directly fixed to the guide plate 140 of the guide 136 with, for example, a screw (not shown). In other words, the blade holder 129 is fixed to the guide 136 that guides the solid lubricant 134. Consequently, the parallelism between the direction in which the cleaning blade 128 is protruded toward the surface of the image carrier 102Y and the pressing direction C can be easily and surely enhanced. The blade holder 129 may be fixed to the guide 136 through some other intermediate element.

In this manner, the positions of the pressing unit and the cleaning blade are respectively set so that the direction in which the pressing unit presses the solid lubricant against the lubricant applying element is almost parallel to the direction in which the cleaning blade is protruded toward the surface of the image carrier. And the blade holder is fixed to the guide, which guides the solid lubricant, directly or through another element, thereby downsizing the image forming apparatus.

Figure 13:
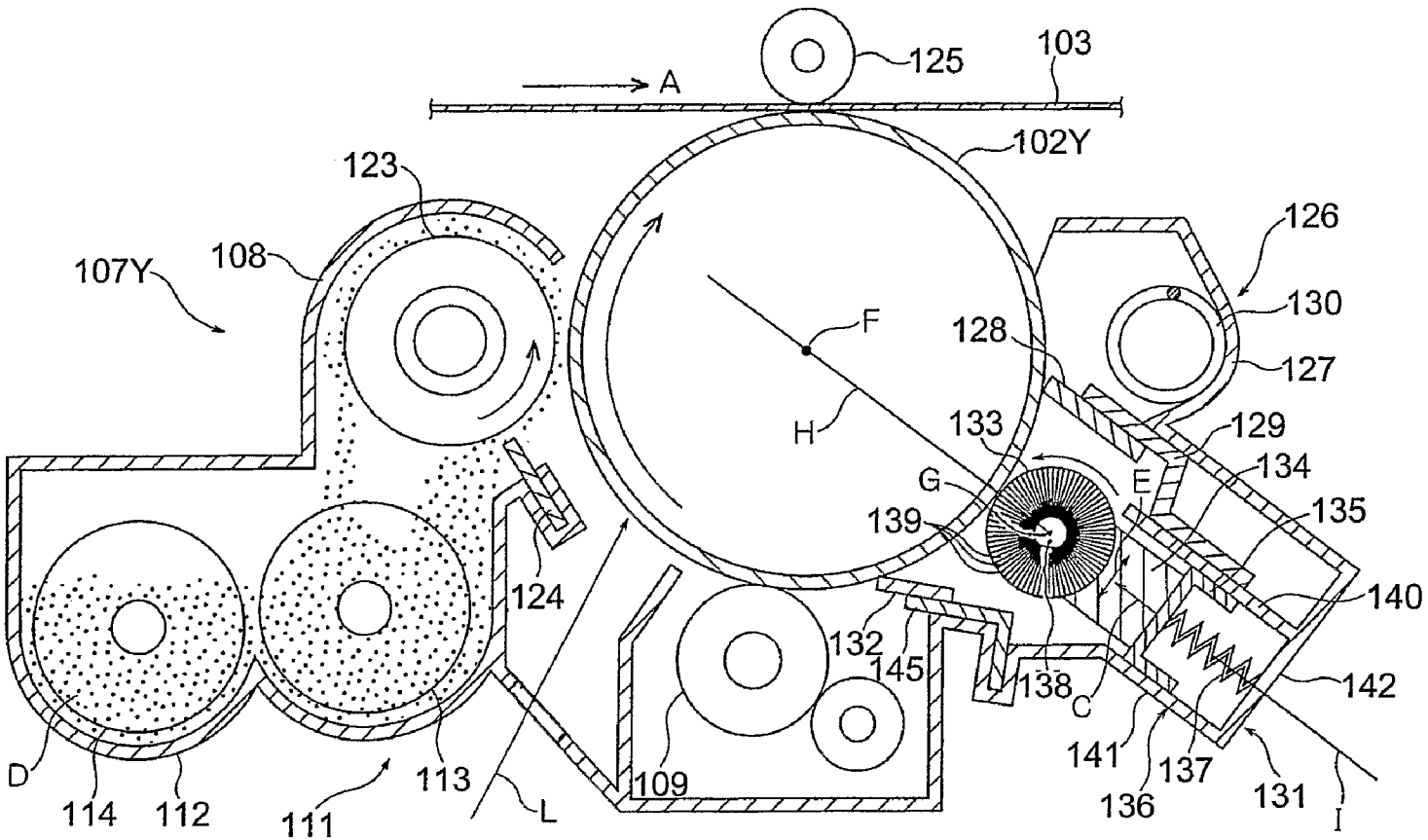
FIG. 13 is a cross-section of a process cartridge having another configuration different from that of FIG. 10.

In the image forming apparatus as shown in FIG. 13, positions of the image carrier 102Y, the lubricant applying element, and the pressing unit are respectively set so that a line H and the pressing direction C are on the substantially same line I. More specifically, the line H connects between a rotation center F of the image carrier 102Y and a rotation center G of the lubricant applying element such as the brush roller 133, and the pressing direction C is a pressing direction of the compressed coil spring 137 toward the solid lubricant 134. As shown in the image forming apparatus of FIG. 11, if the line H and the pressing direction C are not on the same line, the center portion of the brush roller 133 in the longitudinal direction pressed by the compressed coil spring 137 may possibly be deformed as indicated by the chain line of FIG. 12, where the deformation is slightly exaggerated. If the brush roller 133 is thus deformed, the amount of the lubricant applied to the image carrier 102Y becomes nonuniform, which may cause degradation of the toner image transferred to the intermediate transfer belt 103 and of the image quality of the image on the recording medium.

On the other hand, in the process cartridge 107Y as shown in FIG. 13, since the line H and the pressing direction C are on almost the same line I, the center portion of the brush roller 133 in the longitudinal direction which contacts the image carrier is surely caught on the surface of the image carrier 102Y. Therefore, the brush roller 133 is not possibly deformed unlike the deformation indicated by the chain line of FIG. 12. This allows uniform application of the lubricant to the image carrier 102Y and an increase in image quality of the toner image formed on the recording medium P. The other components of the image forming apparatus of FIG. 13 are the same as those of FIG. 10 to FIG. 12, and the same reference numerals of FIG. 11 are assigned to the components the same as or corresponding to the components of FIG. 11.

The image forming apparatus of FIG. 11 includes a lubricant smoothing unit that serves as the smoothing blade 132. The smoothing blade 132 is made of an elastic body such as rubber. The front edge of the smoothing blade 132 contacts the surface of the image carrier 102Y, and the base side thereof is fixed to a holder 145. The smoothing blade 132 is arranged in the trailing direction with respect to the movement direction of the surface of the image carrier. As is clear from FIG. 11, the lubricant applying element including the brush roller 133 is arranged on the downstream side of the cleaning blade 128 in the movement direction of the surface of the image carrier.

In the configuration, the remaining toner adhered to the surface of the image carrier after the toner image is transferred is removed by the cleaning blade 128, and the surface of the image carrier 102Y thus cleaned is applied with the lubricant. The lubricant applied is uniformly spread and smoothed over the surface of the image carrier 102Y while passing through the smoothing blade 132 in contact with the surface of the image carrier 102Y. This allows formation of a lubricant layer having a uniform thickness on the image carrier 102Y. In this manner, the lubricant is applied immediately after the image carrier 102Y is cleaned, and the lubricant applied is smoothed, thereby preventing deviation of the application amount of the lubricant to the surface of the image carrier 102Y and deviation of the frictional coefficient of the surface thereof, and increasing the quality of image formed on the recording medium. Moreover, because the smoothing blade 132 is arranged in the trailing direction with respect to the movement direction of the surface of the image carrier 102Y, the drive torque of the image carrier 102Y can be prevented from being too high.

The thickness of the brush fibers of the brush roller 133 in the lubricant applying device 131 is preferably 3 to 8 deniers, and the density of the brush fibers 139 is preferably 20,000 to 100,000 lines/inch$^2$. If the thickness of the brush fiber is too thin, the bristles become easily bent when the brush roller 3*a* contacts the surface of the image carrier 102Y. Conversely, if the brush fiber is too thick, the density of the fibers cannot be increased. If the density of the brush fibers is low, the lubricant cannot be uniformly applied to the surface of the image carrier 102Y because the number of brush fibers contacting the surface thereof is small. Conversely, if the density of brush fibers is too high, a gap between a fiber and a fiber becomes narrower, and an adhesion amount of the powdery lubricant scraped-off is reduced, which causes a shortage of the application amount.

The same solid lubricant as the solid lubricant 134 of the first embodiment is used in the third embodiment.

It is preferred that the toner used in the developing device 111 is such that a volume-average particle size is 10 micrometers or less and a ratio (Dv/Dn) between the volume-average particle size (Dv) and a number-average particle size (Dn) is in a range from 1.00 to 1.40, and the volume-average particle size in particular desirably ranges from 3 to 8 micrometers.

By using toner particles having a small particle size, the toner particles can be densely adhered to an electrostatic latent image. However, if the volume-average particle size of toner is too small, the toner particles in the two-component developer are fused onto the surfaces of magnetic carriers during stirring of the developer for a long time in the developing device, to reduce the charging capability of the magnetic carriers. If a one-component developer is used as the developer, filming of the toner particles to the developing roller easily occurs, and the toner particles are easily fused onto an element such as a blade for making the toner thinner. Conversely, if the volume-average particle size is too large, it becomes difficult to obtain a high-resolution and high-quality image. When the toner particles in the developer are consumed, the balance of toner particle sizes may sometimes largely fluctuate.

Furthermore, by narrowing the particle size distribution, a charge amount distribution of toner becomes uniform, thereby obtaining a high quality image with less background fogging, and increasing a transfer rate. However, when Dv/Dn exceeds 1.40, the charge amount distribution is widened and resolution decreases, which is not preferable.

An average particle size and a particle size distribution of toner particles can be measured using Coulter Counter TA-II and Coulter Multisizer II (both manufactured by Coulter Electronics Limited). In the present invention, the Coulter Counter TA-II was used to measure the average particle size and the size distribution by being connected to the interface (manufactured by Nikkaki Bios Co.) which outputs a number (of particles) distribution and a volume distribution, as well as to a personal computer (PC9801: manufactured by NEC Corp.).

In such toner, a proportion of wax and inorganic fine particles occupied in toner particles is increased by reducing a toner particle size. The wax is internally or externally added to toner particles to improve the release property, and the inorganic fine particles are used to improve the fluidity. These additives become a factor of adhesion substances produced on the image carrier. However, the lubricant applying device 131 is installed to form a thin film with uniform lubricant over the whole area on the surface of the image carrier, thereby reducing adhesion force of the adhesion substances to the surface of the image carrier 102Y. Furthermore, the installation of the lubricant applying device 131 allows reduction in the frictional force between the surface of the image carrier and the cleaning blade 128 of the cleaning device 126 or the lubricant smoothing blade 132, and performance of satisfactory cleaning.

When toner used in the developing device 111 has an average circularity of 0.93 to 1.00, significant effect can be obtained as the result of applying the lubricant to the image carrier. By applying the lubricant to the image carrier, even if the toner having high circularity is used, such defect that the toner scrapes through under the cleaning blade 128 can be efficiently suppressed.

The average circularity of toner is a value obtained by optically detecting a particle, projecting the particle onto a plane to obtain an area of the particle projected, and dividing the area by a circumferential length of a circle having an area equivalent to the area of the particle projected. The average circularity is measured actually by using the flow particle image analyzer (FPIA-2000: manufactured by Sysmex Corp.). Water of 100 to 150 milliliters from which impurity solid is previously removed is put into a predetermined container, 0.1 to 0.5 milliliter of surfactant being a dispersing agent is added to the water, and sample to be measured is further added thereto by about 0.1 to 9.5 grams. A suspension with the sample dispersed therein is dispersed for about 1 to 3 minutes by an ultrasonic disperser, and concentration of a dispersing solution is controlled to 3,000 to 10,000 pieces/μL, and the shape and the distribution of toner particles are measured.

The toner used in the developing device 111 has the shape factor SF-1 ranging preferably from 100 to 180 and the shape factor SF-2 ranging also preferably from 100 to 180. The shape factor SF-1 indicates the degree of sphericity of toner shape. When the value of SF-1 is 100, the shape of the toner becomes perfect sphericity, and when the value of the SF-1 is larger; the toner shape becomes more irregular. The shape factor SF-2 indicates the degree of irregularities in the shape of toner. When the value of SF-2 is 100, no irregularities are found on the surface of the toner, and when the value of the SF-2 is larger, the irregularities on the surface of the toner become more significant. See JP-A No. 2002-244485 for details of these.

If the shape of the toner is close to sphericity, a contact between a toner particle and a toner particle or between a toner particle and the image carrier is closer to a point contact. Therefore, fluidity becomes higher as the attracting force between toner particles gets weaker. The attracting force between the toner particle and the image carrier also gets weak, and as a result, a transfer rate becomes high. Since the spherical toner easily enters the space between the cleaning blade 128 and the image carrier 102Y, the shape factor SF-1 or the shape factor SF-2 of toner should be large to some extent. However, if the SF-1 and the SF-2 become too large, toner particles scatter over an image, and image quality is thereby degraded. Therefore, it is preferable that the SF-1 and the SF-2 do not exceed 180. The shape factor was measured specifically by photographing toner with the scanning electron microscope (S-800: manufactured by Hitachi Ltd.), introducing the photograph into the image analyzer (LUZEX3: manufactured by Nireco Corp.), and analyzing and calculating it.

The toner adequately used in the image forming apparatus according to the third embodiment is obtained by allowing a toner material solution to undergo crosslinking reaction and/or elongation reaction in an aqueous medium in the presence of resin fine particles. The toner material solution is a toner composition obtained by dispersing at least a polyester prepolymer having a functional group that contains nitrogen atoms, a polyester, a colorant, and a release agent in an organic solvent. The constitutional materials of the toner and the method of manufacturing the toner are the same as these in the first embodiment, and hence explanation thereof is omitted.

A glass transition point (Tg) of a native polyester can be measured by the Differential Scanning Calorimeter (DSC). By using the toner manufacturing method, toner having a small particle size and a sharp particle-size distribution can be easily obtained. Furthermore, by strongly stirring the organic solvent in the process of removing it, the shape can be controlled in a range from a perfectly spherical shape to a "rugby ball" shape, and further, the morphology of the surface can also be controlled in a range from a smooth shape to a rough shape.

The external toner shape is preferably almost spherical, and this is the same as that of the embodiments.

In the image forming apparatus as explained above, the image carrier is formed into a drum shape, and the intermediate transfer element is formed with an intermediate transfer belt, but the configuration according to the present invention can be employed even when the image carrier is formed with an endless belt and the intermediate transfer element is formed into a drum shape. The configurations according to the present invention can be used even when an image carrier that carries a toner image thereon is formed with an intermediate transfer element and a transfer material to which the toner image on the image carrier is transferred is a recording medium. In this case, the image forming apparatus is provided with the cleaning blade that removes the remaining toner adhered to the intermediate transfer element after the toner image is transferred, and the lubricant applying device for applying the lubricant to the intermediate transfer element, and the configurations are employed for these components. Furthermore, the present invention is also applicable without any trouble to an image forming apparatus in which a toner image formed on one image carrier, being a photoconductor, is directly transferred to a transfer material, being a recording medium.

The configurations of an image forming apparatus, imaging units, and a cleaning device according to a fourth embodiment of the present invention are the same as these of FIG. 1, FIG. 2, and FIG. 18, and hence, explanation thereof is omitted.

A pressing force is produced when the solid lubricant 3*b* is pressed against and contacted with the brush roller 3*a* upwardly as shown in FIG. 2, when it is pressed against and contacted with the brush roller 3*a* sidewardly as shown in FIG. 18, or when it is pressed against and contacted with the brush roller 3*a* downwardly (not shown). The results of obtaining the pressing force and the deviation of pressing forces between an initial time and an elapsed time (life) (initial pressing force-elapsed time pressing force) are shown in table 4.

TABLE 4

| | | |
|---|---|---|
| Initial time | Pressing force of spring | A |
| | Own weight of lubricant | B |
| Elapsed time | Pressing force of spring | C |
| | Own weight of lubricant | D |

⇩

| Pressing direction toward lubricant | | From lower side of brush | From side of brush | From upper side of brush |
|---|---|---|---|---|
| Pressing direction toward solid lubricant | Initial time | A - B | A | A + B |
| | Elapsed time | C - D | C | C + D |
| Deviation of pressing forces toward lubricant (Initial time - Elapsed time) | | A - B - C + D | A - C | A + B - C - D |

It is understood from the table 4 that the pressing force applied to the brush roller 3*a* and the deviation of the pressing forces are different depending on the pressing direction toward the solid lubricant 3*b*.

The pressing force and the deviation of the pressing forces in an actual lubricant applying device are explained below. Two models, model G and model J, were used for the following comparisons, and the results of the comparisons are shown in table 5. The deviation of the pressing forces, when the solid lubricant 3*b* is pressed downwardly, increases by 42% in model G and by 22% in model J as compared with the case where the solid lubricant 3*b* is pressed upwardly.

TABLE 5

| | | Model G (A4 Machine) | Model J (A3 Machine) |
|---|---|---|---|
| Initial time | Pressing force of spring (mN) | 1480 | 1800 |
| | Own weight of lubricant (mN) | 167 | 363 |
| Elapsed time | Pressing force of spring (mN) | 1140 | 900 |
| | Own weight of lubricant (mN) | 108 | 274 |

⇩

| Pressing direction toward solid lubricant | | | From lower side of brush | From side of brush | From upper side of brush |
|---|---|---|---|---|---|
| Deviation of pressing forces toward lubricant (Initial time - Elapsed time) | Initial time | (mN) | 281 | 340 | 399 |
| | | (%) | 100 | 121 | 142 |
| | Elapsed time | (mN) | 812 | 900 | 988 |
| | | (%) | 100 | 111 | 122 |

It is understood that the application amount of the lubricant largely fluctuates when the deviation of the pressing forces is large because the required application amount of the lubricant is different depending on the models and a multiplier of a pressure spring to be used is different due to restriction to layout, although the magnitude of the deviation cannot be compared between the models in a simple manner. The large fluctuations may lead to an excessive application in the initial stage or to a shortage of application when time is elapsed. Consequently, when the deviation of the pressing forces is smaller, more stable application can be achieved.

Accordingly, the arrangement, as shown in FIG. 2, in which the solid lubricant 3*b* is pressed upwardly, that is, from the lower side of the brush roller 3*a*, allows more stable application of the lubricant as compared with the sideward application and the downward application.

The configuration of the solid lubricant 3*b* of the lubricant applying device 3 is the same as that of FIG. 7.

By providing the solid lubricant 3*b* and the cleaning device 8, which are configured in the above manner, in the image forming apparatus, an appropriate amount of the lubricant can be applied to the surface of the photoconductor 1, thereby forming a thin film with the smoothed lubricant without non-uniform application.

The solid lubricant 3*b* or the brush roller 3*a* moves in the longitudinal direction which is perpendicular to the rotation direction of the brush roller 3*a*, thereby preventing nonuniform application caused when the brush roller 3*a* unevenly contacts the solid lubricant 3*b*.

The lubricant is applied after the remaining toner is cleaned in the above manner, and further, the lubricant applied is smoothed to form a thin film, thereby preventing both the defects occurring in "the cleaning after the application" such that the photoconductor is cleaned only after the lubricant is applied and in "the application after the cleaning" such that the lubricant is applied after the photoconductor is cleaned. More specifically, the deviation of the application amount of the lubricant and the deviation of the static frictional coefficient of the surface due to the "the cleaning after the application" can be prevented, and the abnormal images such as the worm hole, the image blur, and the rough image due to non-uniform lubricant layer caused by "the application after the cleaning" without smoothing it can also be prevented. At the same time, the application function of the brush roller 3*a* can be maintained over the long period of time. Since the rubber is used for the lubricant smoothing blade 8*b*, even if the photoconductor 1 is moved being in contact with the lubricant smoothing blade 8*b*, the surface of the photoconductor 1 is not possibly damaged.

In the present invention, the wear of the cleaning blade 8*a* and the surface of the photoconductor 1 can be prevented, and even if the toner having a small particle size is used, the toner remaining on the surface thereof after the toner image is transferred can be satisfactorily cleaned. Moreover, the image blur can be prevented. The image blur may occur when the surface of the photoconductor 1 is affected by humidity due to excessive application of the lubricant.

In the fourth embodiment, the cleaning blade 8*a* is used to clean the surface of the photoconductor 1, but a cleaning brush may also be used instead of the cleaning blade 8*a*. The cleaning brush is obtained by applying bias to a conductive brush having a resistance between a medium resistance and a low resistance.

The present invention is not limited by the embodiments, but is applicable to any device that uses the technological principles of the present invention. The photoconductor or the intermediate transfer element may be either one of a belt shape and a roller shape.

In the fourth embodiment, tests were conducted by comparing a method according to the present invention, with the conventional method. The method according to the present invention was such that the lubricant smoothing blade 8*b* was made to contact the surface of the photoconductor 1 in the trailing manner to smooth the lubricant applied. The effect of the present invention as the results of the tests is verified in the same manner as that of the second embodiment.

Working examples of the present invention are explained below.

Figure 16:
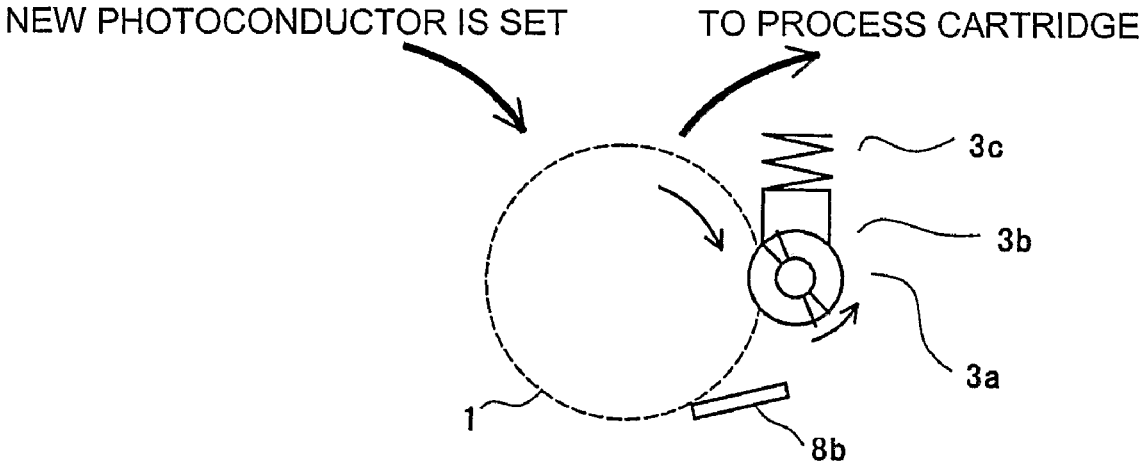
FIG. 16 is a diagram of how to manufacture an image carrier having a low frictional coefficient using the lubricant applying device according to the present invention.
Figure 17:
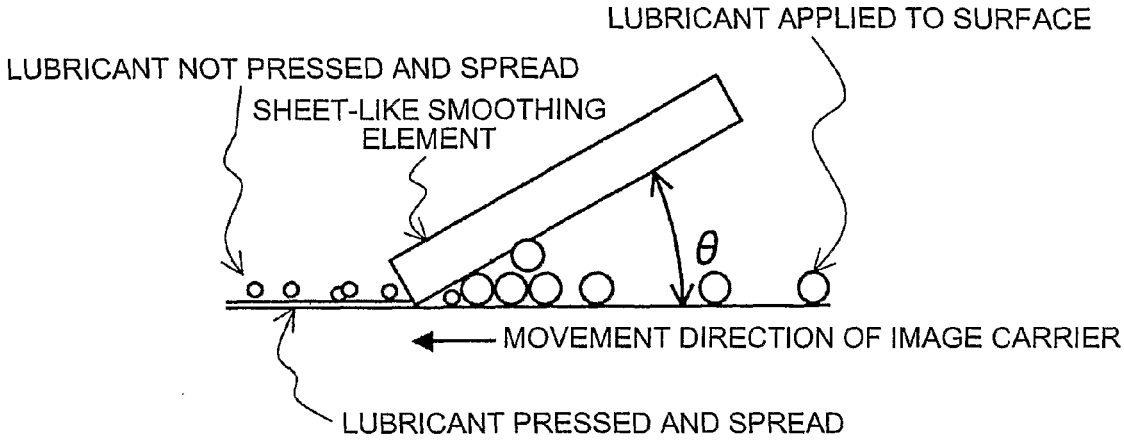
FIG. 17 is a diagram of an angle between the lubricant applying device according to the present invention and a sheet-like smoothing element which is a main portion thereof, and how the lubricant is pressed and spread.

FIG. 16 is a diagram of how to manufacture an image carrier having a low frictional coefficient using the lubricant applying device according to the present invention. FIG. 17 is a diagram of an image on an "angle θ" between the lubricant applying device according to the present invention and a sheet-like smoothing element being its main portion, and on how the lubricant is pressed and spread.

FIRST WORKING EXAMPLE

A lubricant applying device was prepared in the following manner. As a sheet-like smoothing element, an urethane rubber sheet having a thickness of 2 millimeters, manufactured by Bando Chemical Industries, Ltd., was used and set in a trailing posture so that a contact pressure can be changed in a range of 25±10 (g/cm) and a contact angle in a range of 0 to 90 degrees upon setting of a photoconductor. And, as an applying brush, a conductive nylon brush having a bristle length of 3 millimeters, manufactured by Toeisangyo Co., Ltd., was used and set so that the applying brush was pressed into the photoconductor by an amount of 1 millimeter. The lubricant applying device thus prepared was used to run idle (approximately 5 to 10 minutes) until the lubricant was sufficiently applied to the photoconductor, and the photoconductor with the sufficient lubricant was used to prepare a process cartridge.

The process cartridge was set in imagio NeoC325 manufactured by Ricoh Co., Ltd., and 1,000 sheets of paper were continuously passed through the cartridge on the condition of the image formed on A4-size white paper passed therethrough in horizontal orientation, under the environment of 35° C., 80%. The results are as follows. When the contact angle was less than 10 degrees, a cleaning sheet was rolled in (indicated by "cross:x" in table 6), but in the other cases, no sheet roll-in occurred (indicated by "circle:○" in table 6).

TABLE 6

| | Angle (degree) | | | | | | | | | |
|---|---|---|---|---|---|---|---|---|---|---|
| | 5 | 8 | 10 | 20 | 30 | 40 | 50 | 60 | 70 | 80 |
| Sheet Roll-in | x | x | ○ | ○ | ○ | ○ | ○ | ○ | ○ | ○ |

SECOND WORKING EXAMPLE

A lubricant applying device was prepared in the following manner. As a sheet-like smoothing element, an urethane rubber sheet having a thickness of 1.6 millimeters, manufactured by Hokushin Corp., was used and set in a trailing posture so that a contact pressure can be changed in a range of 55±10 (g/cm) and a contact angle in a range of 0 to 90 degrees upon setting of a photoconductor. And, as an applying brush, a conductive nylon brush having a bristle length of 2.5 millimeters, manufactured by Tsuchiya Co., Ltd., was used and set so that the applying brush was pressed into a photoconductor by an amount of 0.5 millimeter. The lubricant applying device thus prepared was used to run idle (approximately 5 to 10 minutes) until the lubricant was sufficiently applied to the photoconductor, and the photoconductor with the sufficient lubricant was used to prepare a process cartridge.

The process cartridge was set in imagio NeoC325 manufactured by Ricoh Co., Ltd., and 1,000 sheets of paper were continuously passed through the cartridge on the condition of the image formed on A4-size white paper passed therethrough in horizontal orientation, under the environment of 35° C., 80%. The results are as follows. When the contact angle was less than 10 degrees, a cleaning sheet was rolled in (indicated by "cross:x" in table 7), but in the other cases, no sheet roll-in occurred (indicated by "circle:○" in table 7).

TABLE 7

| | Angle (deg) | | | | | | | | | |
|---|---|---|---|---|---|---|---|---|---|---|
| | 5 | 8 | 10 | 20 | 30 | 40 | 50 | 60 | 70 | 80 |
| Sheet Roll-in | x | x | ○ | ○ | ○ | ○ | ○ | ○ | ○ | ○ |

THIRD WORKING EXAMPLE

A lubricant applying device was prepared in the following manner. As a sheet-like smoothing element, an urethane rubber sheet having a thickness of 1.5 millimeters, manufactured by Toyo Tire and Rubber Co., Ltd., was used and set in a trailing posture so that a contact pressure can be changed in a range of 20±10 (g/cm) and a contact angle in a range of 0 to 90 degrees upon setting of a photoconductor. And, as an applying brush, a conductive nylon brush having a bristle length of 3 millimeters, manufactured by Tsuchiya Co., Ltd., was used and set so that the applying brush was pressed into the photoconductor by an amount of 1 millimeter. The lubricant applying device thus prepared was used to run idle (approximately 5 to 10 minutes) until the lubricant was sufficiently applied to the photoconductor, and the photoconductor with the sufficient lubricant was used to prepare a process cartridge.

The process cartridge was set in imagio NeoC325 manufactured by Ricoh Co., Ltd., and 1,000 sheets of paper were continuously passed through the cartridge on the condition of the image formed on A4-size white paper passed therethrough in horizontal orientation, under the environment of 35° C., 80%. The results are as follows. When the contact angle was less than 10 degrees, a cleaning sheet was rolled in (indicated by "cross:x" in table 8), but in the other cases, no sheet roll-in occurred (indicated by "circle:○" in table 8).

TABLE 8

| | Angle (degree) | | | | | | | | | |
|---|---|---|---|---|---|---|---|---|---|---|
| | 5 | 8 | 10 | 20 | 30 | 40 | 50 | 60 | 70 | 80 |
| Sheet Roll-in | x | x | ○ | ○ | ○ | ○ | ○ | ○ | ○ | ○ |

FOURTH WORKING EXAMPLE

A process cartridge was prepared in the following manner. As a cleaning sheet, an urethane rubber sheet having a thickness of 2 millimeters, manufactured by Bando Chemical Industries, Ltd., was used and set so that a contact pressure was in a range of 20±10 (g/cm) and a contact angle in a range of 75±10 degrees with respect to a photoconductor. As an applying brush, a conductive nylon brush having a bristle length of 3 millimeters, manufactured by Toeisangyo Co., Ltd., was used and set so that the applying brush was pressed into the photoconductor by an amount of 1 millimeter. As a sheet-like smoothing element, an urethane rubber sheet having a thickness of 1.5 millimeters, manufactured by Toyo Tire and Rubber Co., Ltd., was used and set so that a contact angle was in a range of 15±5 degrees and a contact linear pressure was variously changed.

The process cartridge was set in imagio NeoC325 manufactured by Ricoh Co., Ltd., and 1,000 sheets of paper were continuously passed through the cartridge on the condition of the image formed on A4-size white paper passed therethrough in horizontal orientation under laboratory environment, to check whether the inside of the machine was contaminated. The results are as follows. When the contact linear pressure was less than 0.01 (N/cm), the contamination inside the machine was verified (indicated by "cross:x" in table 9), but in the other cases, no such problem occurred (indicated by "circle:○" in table 9).

TABLE 9

| | Presure (N/cm) | | | | | | | |
|---|---|---|---|---|---|---|---|---|
| | 0.001 | 0.005 | 0.01 | 0.05 | 0.1 | 0.5 | 1.0 | 5.0 |
| Contamination | x | x | ○ | ○ | ○ | ○ | ○ | ○ |

FIFTH WORKING EXAMPLE

A process cartridge was prepared in the following manner. As a cleaning sheet, an urethane rubber sheet having a thickness of 2 millimeters, manufactured by Hokushin Corp., was used and set so that a contact pressure was in a range of 25±10 (g/cm) and a contact angle in a range of 70±10 degrees with respect to a photoconductor. As an applying brush, an insulation polyester brush having a bristle length of 3 millimeters, manufactured by Tsuchiya Co., Ltd., was used and set so that the applying brush was pressed into the photoconductor by an amount of 1 millimeter. As a sheet-like smoothing element, an urethane rubber sheet having a thickness of 1 millimeter, manufactured by Toyo Tire and Rubber Co., Ltd., was used and set so that a contact angle was in a range of 25±5 degrees and a contact linear pressure was variously changed.

The process cartridge was set in imagio NeoC325 manufactured by Ricoh Co., Ltd., and 1,000 sheets of paper were continuously passed through the cartridge on the condition of the image formed on A4-size white paper passed therethrough in horizontal orientation under laboratory environment, to check whether the inside of the machine was contaminated. The results are as follows. When the contact linear pressure was less than 0.01 (N/cm), the contamination inside the machine was verified (indicated by "cross:x" in table 10), but in the other cases, no such problem occurred (indicated by "circle:○" in table 10).

TABLE 10

| | Presure (N/cm) | | | | | | | |
|---|---|---|---|---|---|---|---|---|
| | 0.001 | 0.005 | 0.01 | 0.05 | 0.1 | 0.5 | 1.0 | 5.0 |
| Contamination | x | x | ○ | ○ | ○ | ○ | ○ | ○ |

SIXTH WORKING EXAMPLE

A process cartridge was prepared in the following manner. As a cleaning sheet, an urethane rubber sheet having a thickness of 1.6 millimeters, manufactured by Toyo Tire and Rubber Co., Ltd., was used and set so that a contact pressure was in a range of 55±10 (g/cm) and a contact angle in a range of 70±10 degrees with respect to a photoconductor. As an applying brush, an insulation polyester brush having a bristle length of 2.5 millimeters, manufactured by Tsuchiya Co., Ltd., was used and set so that the applying brush was pressed into the photoconductor by an amount of 0.5 millimeter. As a sheet-like smoothing element, an urethane rubber sheet having a thickness of 1.3 millimeters, manufactured by Bando Chemical Industries, Ltd., was used and set so that a contact angle was in a range of 22±5 degrees and a contact linear pressure was variously changed.

The process cartridge was set in imagio NeoC325 manufactured by Ricoh Co., Ltd., and 1,000 sheets of paper were continuously passed through the cartridge on the condition of the image formed on A4-size white paper passed therethrough in horizontal orientation under laboratory environment, to check whether the inside of the machine was contaminated. The results are as follows. When the contact linear pressure was less than 0.01 (N/cm), the contamination inside the machine was verified (indicated by "cross:x" in table 11), but in the other cases, no such problem occurred (indicated by "circle:○" in table 11).

TABLE 11

| | Presure (N/cm) | | | | | | | |
|---|---|---|---|---|---|---|---|---|
| | 0.001 | 0.005 | 0.01 | 0.05 | 0.1 | 0.5 | 1.0 | 5.0 |
| Contamination | x | x | ○ | ○ | ○ | ○ | ○ | ○ |

In the image forming apparatus according to the present invention, toner used in the developing device 4 preferably has the volume-average particle size ranging from 3 to 8 micrometers, and has a ratio (Dv/Dn) between the volume-average particle size (Dv) and the number-average particle size (Dn) ranging from 1.00 to 1.40.

By using toner particles having a small particle size, the toner particles can be densely adhered to a latent image. However, if the volume-average particle size is smaller than the range of the present invention, toner particles in a two-component developer are fused onto the surfaces of magnetic carriers during its stirring for a long period of time in the developing device, to reduce the charging capability of the magnetic carriers. If a one-component developer is used as the developer, filming of the toner particles to the developing roller easily occurs, and the toner particles are easily fused to an element such as a blade for making the toner thinner. Conversely, if the volume-average particle size is larger than the range of the present invention, it becomes difficult to obtain a high-resolution and high-quality image. When toner particles in the developer are consumed, the balance of toner particle sizes may sometimes largely fluctuate.

Furthermore, by narrowing the particle size distribution, a charge amount distribution of toner becomes uniform, thereby obtaining a high quality image with less background fogging, and increasing a transfer rate. However, when Dv/Dn exceeds 1.40, the charge amount distribution is widened and resolution decreases, which is not preferable.

An average particle size and a particle size distribution of toner particles can be measured using Coulter Counter TA-II and Coulter Multisizer II (both manufactured by Coulter Electronics Limited). In the present invention, the Coulter Counter TA-II was used to measure the average particle size and the size distribution by being connected to an interface (manufactured by Nikkaki Bios Co.) which outputs a number (of particles) distribution and a volume distribution, as well as to a personal computer (PC9801: manufactured by NEC Corp.).

In such toner, a proportion of wax and inorganic fine particles occupied in toner particles is increased by reducing toner particle size as compared with that of conventional toner particles. The wax is internally or externally added to toner particles to improve the release property, and the inorganic fine particles are used to improve the fluidity. These additives become a factor of adhesion substances produced on the photoconductor 1. The lubricant applying device 3 according to the present invention is therefore installed to form a thin film with uniform lubricant over the whole area on the surface of the photoconductor 1, thereby reducing adhesion force of the adhesion substances to the surface of the photoconductor 1. Furthermore, the frictional force between the surface of the photoconductor 1 and the cleaning blade 8*a* of the cleaning device 8 or the lubricant smoothing blade 8*b* is reduced to enable satisfactory cleaning.

When toner particles used in the developing device 4 have high circularity such as an average circularity of 0.93 or higher, the effect of providing the cleaning device 8 of the present invention in an image forming apparatus is significant. The toner particles having high circularity easily enter the space between the photoconductor 1 and the cleaning blade during cleaning using the blade system, and easily slip through the space. If the contact pressure of the cleaning blade to the photoconductor 1 is increased, the photoconductor 1 is largely damaged. Further, in the method of applying a bias having opposite polarity to charge polarity of toner, to the brush roller, and electrostatically collecting toner, it is difficult to remove the toner from the brush roller. Therefore, electrostatic toner removal capability tends to decrease gradually.

However, the cleaning device 8 of the present invention allows efficient cleaning of the surface of the photoconductor 1 in the following manner even if the toner particles have high average circularity. More specifically, at first, the toner particles remaining on the photoconductor 1 are electrostatically collected by the electrostatic cleaning element, and then, the remaining toner particles are finally scraped off by the cleaning blade 8*a* and removed. Thus, efficient cleaning can be performed without damage to the surface of the photoconductor 1.

The average circularity of toner is a value obtained by optically detecting a particle, projecting the particle onto a plane to obtain an area of the particle projected, and dividing the area by a circumferential length of a circle having an area equivalent to the area of the particle projected. Actually, the average circularity is measured by using a flow particle image analyzer (FPIA-2000: manufactured by Sysmex Corp.). Water of 100 to 150 milliliters from which impurity solid is previously removed is put into a predetermined container, 0.1 to 0.5 milliliter of surfactant being a dispersing agent is added to the water, and sample to be measured is further added thereto by about 0.1 to 9.5 grams. A suspension with the sample dispersed therein is dispersed for about 1 to 3 minutes by an ultrasonic disperser, and concentration of a dispersing solution is controlled to 3,000 to 10,000 pieces/μL, and the shape and the distribution of toner particles are measured.

The toner used in the image forming apparatus according to the present invention has the shape factor SF-1 ranging preferably from 100 to 180 and the shape factor SF-2 ranging also preferably from 100 to 180.

The toner adequately used in the image forming apparatus according to the present invention is obtained by allowing toner material solution to undergo crosslinking reaction and/or elongation reaction in an aqueous medium. The toner material solution is obtained by dispersing at least a polyester prepolymer having a functional group that contains nitrogen atoms, a polyester, a colorant, and a release agent in an organic solvent.

The constitutional materials of toner and the method of manufacturing toner are also the same as these of the first embodiment, and explanation thereof is omitted.

The molecular weight of polymer produced with modified polyester can be measured, using Gel Permeation Chromatography (GPC), with THF as a solvent.

The shape of the toner according to the fourth embodiment is almost spherical, and this is as explained above.

More specifically, the toner manufactured can be used as one-component magnetic toner that does not use magnetic carrier or as non-magnetic toner.

When the toner is used for the two-component developer, the toner may be mixed with magnetic carrier. The magnetic carrier is ferrite that contains divalent metal such as iron, magnetite, Mn, Zn, and Cu, and its volume-average particle size is preferably 20 to 100 micrometers. If the average particle size is less than 20 micrometers, then the carrier is easily adhered to the photoconductor 1 upon development. If it exceeds 100 micrometers, then carrier is not easily mixed with toner, and the charge amount of toner is not sufficient. Therefore, charging failure easily occurs during continuous use. Zn-containing Cu ferrite is preferred because its saturated magnetization is high, but it can be selected as required according to the process of the image forming apparatus 100. Resin covering the magnetic carrier is not particularly limited, but includes, for example, the resin includes silicone resin, styrene-acrylic resin, fluororesin, and olefin resin. The manufacturing method of the resin may be either one of methods as follows: a method of dissolving coating resin in a solvent and spraying the solvent into a fluidized bed to coat carrier cores, and another method of electrostatically adhering resin particles to core particles and thermally fusing the resin particles to cover the core particles. The thickness of the core particle covered with resin is 0.05 to 10 micrometers, preferably 0.3 to 4 micrometers.

INDUSTRIAL APPLICABILITY

As described above, an image forming apparatus, a lubricant applying device, a transfer device, a process cartridge, and toner used for an image carrier of the image forming apparatus according to the present invention are useful for image forming apparatuses such as a copying machine, a printing machine, a facsimile and so on, using an electronic photographic process, especially, these are useful for maintaining an appropriate frictional coefficient of the surface of a photoconductor and a transfer device and useful for obtaining stable image quality.

The invention claimed is:

1. An image forming apparatus, comprising:

a latent image carrier that is rotatable and carries a latent image;

a cleaning blade that cleans toner remaining on a cleaning area on the latent image carrier;

a lubricant;

a lubricant applying brush roller that scrapes off the lubricant and applies scraped lubricant to the latent image carrier; and a lubricant applying blade arranged on a downstream side of an applying apparatus of the cleaning blade with respect to direction of rotation of the latent image carrier, and that applies a lubricant on the latent image carrier, wherein a lubricant applying area overlaps the cleaning area of the cleaning blade, and wherein a width of the lubricant is less than a width of the brush roller and the width of the brush roller is less than a width of the lubricant applying blade in contact with the latent image carrier in a longitudinal direction thereof in the image forming apparatus.

2. The image forming apparatus according to claim 1, wherein the cleaning area and the lubricant applying area have a substantially equal size on the latent image carrier.

3. The image forming apparatus according to claim 1, wherein widths of a charged portion and a lubricant applied on the latent image carrier in a longitudinal direction have a relation:

charge width<width of lubricant applied.

4. The image forming apparatus according to claim 1, wherein the latent image carrier has a frictional coefficient of 0.4 or less.

5. The image forming apparatus according to claim 1, wherein the cleaning blade includes a side seal that prevents toner scattering, and the lubricant applying area can be adjusted based on a position of the side seal.

6. The image forming apparatus according to claim 1, wherein the toner is such that a shape factor indicating a degree of sphericity of a toner shape is in a range from 100 to 180, and a shape factor indicating a degree of irregularities of the toner shape is in a range from 100 to 180.

7. The image forming apparatus according to claim 1, wherein a volume-average particle size (Dv) of the toner is in a range from 3 to 8 micrometers, and a degree of dispersion of the toner defined by a ratio (Dv/Dn) between the volume-average particle size (Dv) and a number-average particle size (Dn) is in a range from 1.00 to 1.40.

8. The image forming apparatus according to claim 1, wherein a ratio (r2/r1) between a minor axis (r2) and a major axis of the toner (r1) is in a range from 0.5 to 1.0, a ratio (r3/r2) between a thickness of the toner (r3) and the minor axis of the toner (r2) is in a range from 0.7 to 1.0, and $r1 \geqq r2 \geqq r3$.

9. The image forming apparatus according to claim 1, wherein the toner is obtained by allowing a toner material solution to undergo either one of or both of a crosslinking reaction and an elongation reaction in an aqueous medium, the toner material solution being obtained by dissolving or dispersing at least a polymer having a portion enabling reaction with a compound that contains an active hydrogen group, and a release agent in an organic solvent.

10. The image forming apparatus according to claim 1, further comprising:

a process cartridge that integrally supports the latent image carrier and at least one of a lubricant applying device which applies the lubricant to the latent image carrier, a charging device, a developing device, and a cleaning device, the process cartridge being mounted detachably from the image forming apparatus.

11. A process cartridge coupled to an image forming apparatus, the process cartridge comprising:

an image carrier on which a latent image is formed; and a process unit that includes at least one of:

a cleaning device that cleans a surface of the image carrier;

a lubricant applying brush roller that scrapes off the lubricant and applies scraped lubricant to the latent image carrier; and a lubricant applying device arranged on a downstream side of the cleaning device with respect to a direction of rotation of the image carrier, and that applies the lubricant to a lubricant applying area on the image carrier, wherein a cleaning area cleaned by the cleaning device and the lubricant applying area overlap, wherein the process cartridge integrally supports the image carrier and the process unit, and is detachable from the image forming apparatus, and wherein a width of the lubricant is less than a width of the brush roller and the width of the brush roller is less than a width of a lubricant applying blade in contact with the latent image carrier in a longitudinal direction thereof in the image forming apparatus.

12. The image forming apparatus according to claim 1, wherein the lubricant applying blade applies the lubricant to a surface of an intermediate transfer belt.

13. The image forming apparatus according to claim 1, wherein the lubricant includes zinc stearate.

* * * * *